US010480895B2

(12) United States Patent
Barnett

(10) Patent No.: US 10,480,895 B2
(45) Date of Patent: Nov. 19, 2019

(54) WEAPON VIBRATION DAMPENING SYSTEM AND METHOD

(71) Applicant: Barnett Outdoors, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 16/038,677

(22) Filed: Jul. 18, 2018

(65) Prior Publication Data

US 2019/0025008 A1 Jan. 24, 2019

Related U.S. Application Data

(60) Provisional application No. 62/534,257, filed on Jul. 19, 2017.

(51) Int. Cl.

| | |
|---|---|
| ***F41B 5/12*** | (2006.01) |
| ***F41B 5/20*** | (2006.01) |
| ***F41B 5/14*** | (2006.01) |

(52) U.S. Cl.

CPC ..... *F41B 5/1426* (2013.01); *F41B 5/12* (2013.01)

(58) Field of Classification Search

CPC ..... F41B 5/12; F41B 5/1426

See application file for complete search history.

(56) References Cited

U.S. PATENT DOCUMENTS

| | | | | |
|---|---|---|---|---|
| 8,656,899 | B2 * | 2/2014 | Bednar | F41B 5/12 124/25 |
| 9,140,513 | B2 * | 9/2015 | Trpkovski | F41B 5/1426 |
| 10,139,190 | B1 * | 11/2018 | Trpkovski | F41B 5/12 |
| 10,240,890 | B2 * | 3/2019 | Trpkovski | F41B 5/12 |
| 2016/0169612 | A1 * | 6/2016 | Kim | F41B 5/0094 124/25 |

* cited by examiner

*Primary Examiner* — John A Ricci
(74) *Attorney, Agent, or Firm* — Jones Walker LLP

(57) ABSTRACT

A stock for a weapon, such as a crossbow stock, that includes one or more central dampeners, such as first, second, and third central dampeners, and/or one or more component dampeners, such as first, second, and third component dampeners, that function to reduce vibrations transmitted through the stock as a result of weapon firing. The central and/or component dampeners may be positioned in the stock's foregrip section, pistol grip section, crank cocking device section, thumb grip section, rearward end section, and cheek rest section.

40 Claims, 25 Drawing Sheets

WEAPON VIBRATION DAMPENING SYSTEM AND METHOD

CROSS-REFERENCE TO RELATED APPLICATION

This application claims the benefit of and priority to U.S. Provisional Patent Application No. 62/534,257 filed on Jul. 19, 2017, which is incorporated herein by reference in its entirety.

SUMMARY OF THE DISCLOSURE

The present disclosure relates to a vibration dampening system and method for dampening vibrations within a weapon to minimize sound, shock, and vibration. Vibration is inherent in the use of weapons. When weapons are fired, vibration is transmitted through the weapon. For example, when a crossbow is fired, the bowstring's movement produces vibration that is transmitted through the riser and the crossbow stock. Similarly, when a vertical bow is fired, the bowstring's movement produces vibration that is transmitted through the bow limbs and the grip portion of the vertical bow. When a gun is fired, the bullet's movement through the gun produces vibration that is transmitted through a grip portion of the gun. Users holding each of these weapons sense the transmitted vibration on each point of contact with the weapon, causing the user discomfort.

Vibration dampening techniques have been used in the past to alleviate vibration in crossbows. Some examples include the use of dampening on the strings, cables, or the limbs of the crossbow. Previous dampening techniques have primarily been used on the crossbow's riser assembly similar to dampening devices for vertical archery bows. String dampeners are also used in an attempt to dampen the vibration of the strings on the bows.

A vibration dampening system for a weapon described herein is designed to reduce vibration transmitted to a user when the weapon is fired. The vibration dampening system includes one or more dampeners installed on a portion of the weapon that is contacted by the user while firing the weapon. For example, the vibration dampening system may be incorporated into a stock of a crossbow. In another embodiment, the vibration dampening system may be incorporated into a grip portion of a vertical bow. In a further embodiment, the vibration dampening system may be incorporated into a grip portion of a pistol. In yet another embodiment, the vibration dampening system may be incorporated into a grip portion, a butt portion, and a cheek portion of a rifle or a shotgun.

BRIEF DESCRIPTION OF THE DRAWINGS

FIG. 48 is a side view of a rifle including a vibration dampening system.

DETAILED DESCRIPTION OF THE DISCLOSURE

Figure 1:
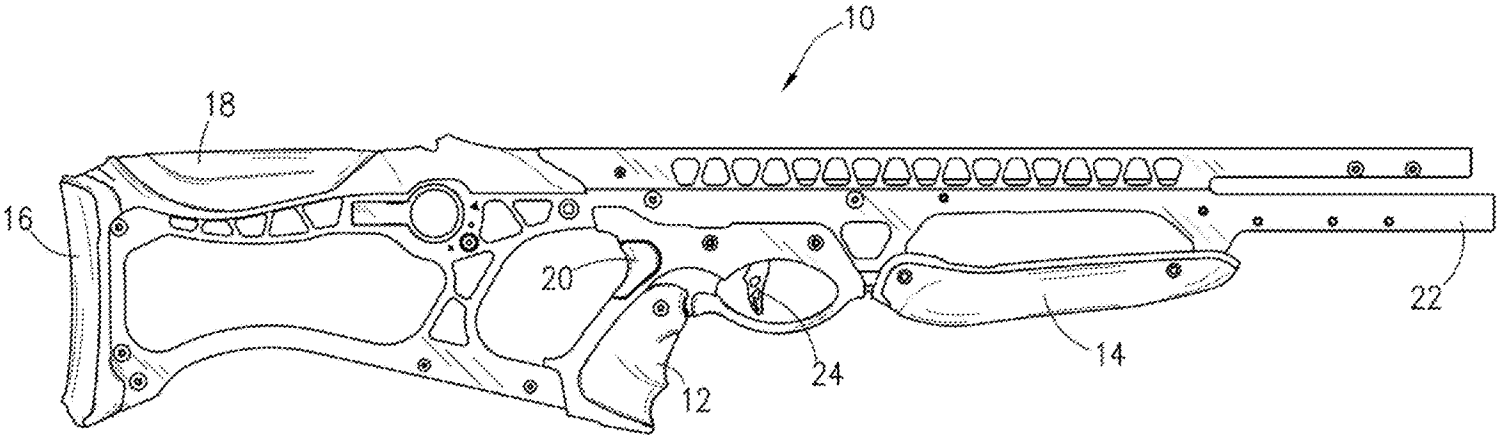
FIG. 1 is a side view of a crossbow stock.

With reference to FIG. 1, crossbow stock 10 includes several portions that are contacted by a user. One of the user's hands engages pistol grip 12 and the other hand engages foregrip 14 when holding crossbow stock 10. The user's shoulder engages butt plate 16 and the user's face may engage cheek rest 18. In one embodiment, crossbow stock 10 may also include thumb grip 20 that is also engaged by a user's hand when holding crossbow stock 10. Specifically, the area between the user's thumb and forefinger engages thumb grip 20. Conventional crossbow stocks do not include thumb grip 20. Instead, this area of the crossbow stock is molded with the remainder of the stock.

As seen in FIG. 1, crossbow stock 10 may be incorporated into a crossbow by affixing a riser and bow prods to forward end 22 of crossbow stock 10, with a bowstring secured to the outer ends of the bow prods. A user cocks the crossbow by pulling the bowstring toward butt plate 16 of crossbow stock 10 until the bow string engages a catch. When the user actuates trigger 24, the bowstring is released. The forward movement of the bow string generates vibration through the bow prods/limbs and riser. Through its attachment to forward end 22, the riser transmits at least a portion of this vibration to crossbow stock 10. The vibration dampening system of this disclosure is incorporated into crossbow stock 10 and also into some or all of the portions of crossbow stock 10 that are contacted by a user when firing the crossbow (e.g., pistol grip 12, foregrip 14, butt plate 16, cheek rest 18, and thumb grip 20).

Figure 2:
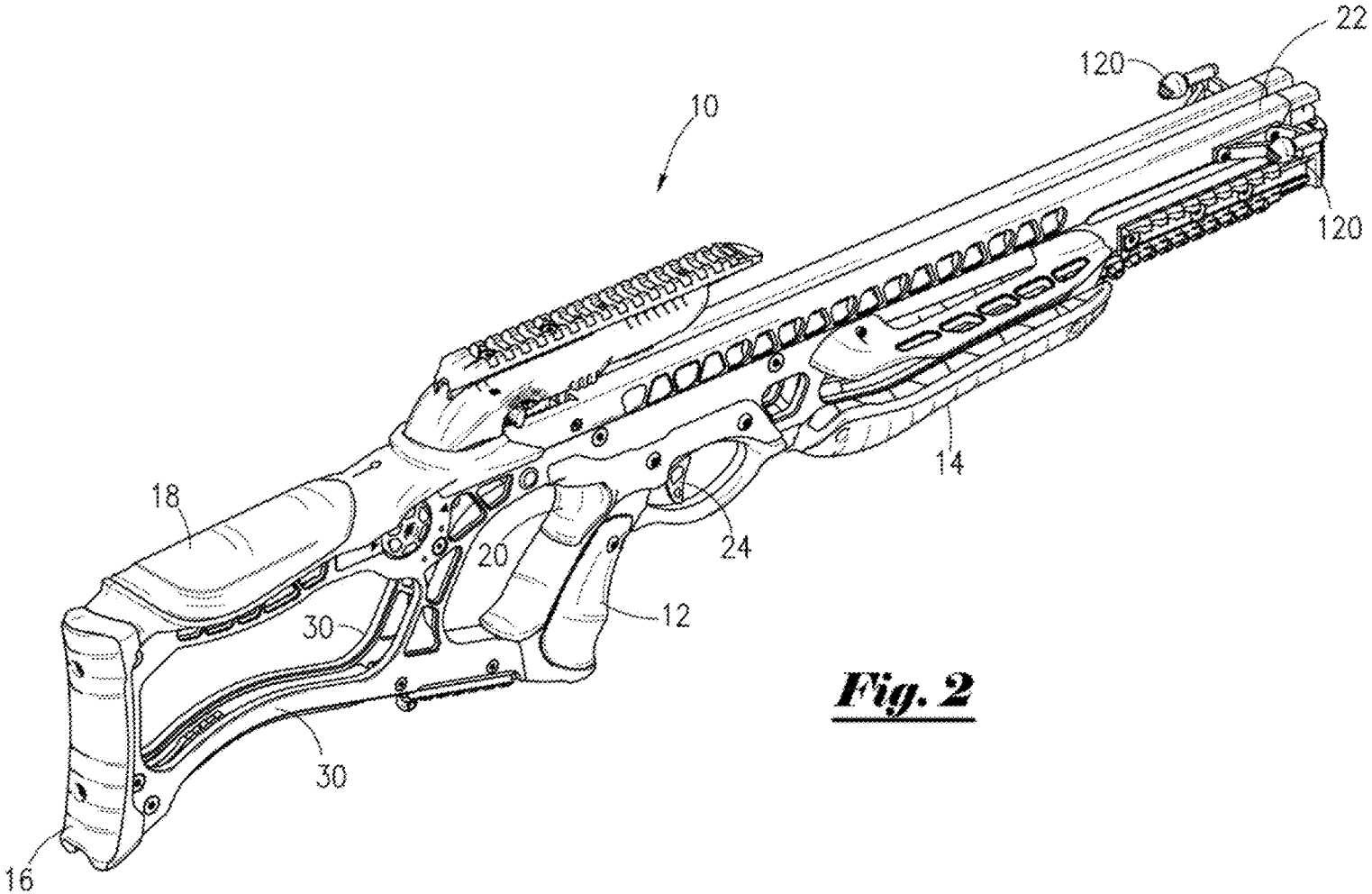
FIG. 2 is a perspective view of a crossbow stock with a vibration dampening system.
Figure 3:
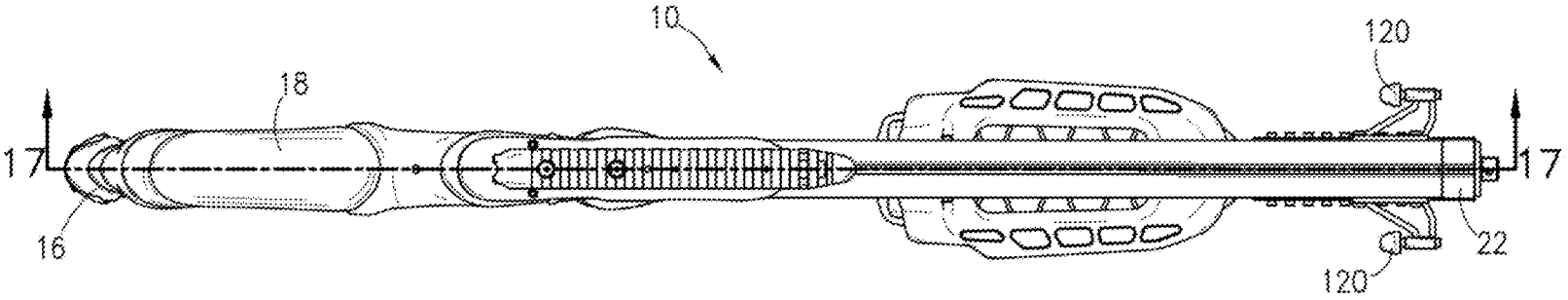
FIG. 3 is a top view of the crossbow stock with the vibration dampening system.
Figure 4:
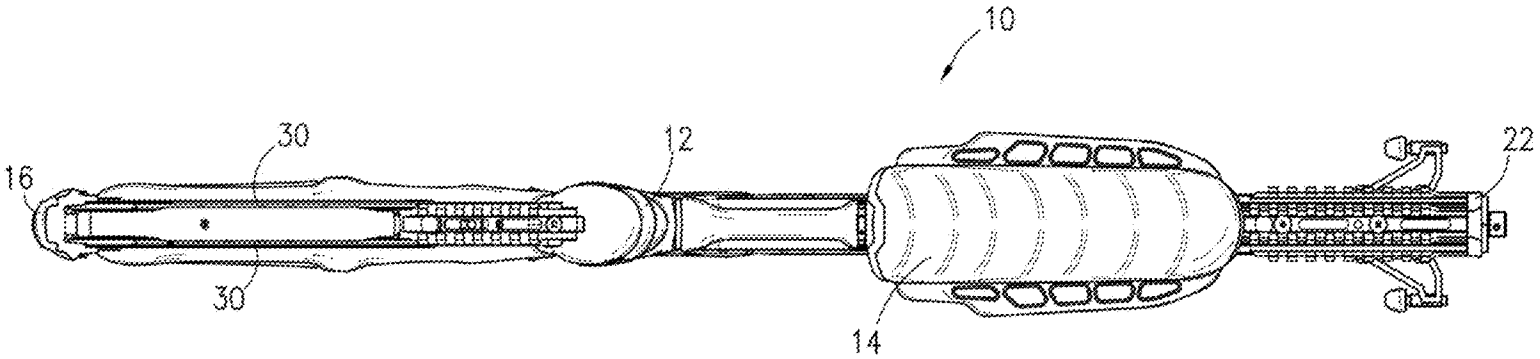
FIG. 4 is a bottom view of the crossbow stock with the vibration dampening system.

FIGS. 2-6 illustrate another embodiment of crossbow stock 10 including the vibration dampening system. In one embodiment, crossbow stock 10 is formed of two body plates 30 generally extending from forward end 22 to butt plate 16. Body plates 30 are positioned parallel to one another as shown in FIGS. 2 and 4, with one body plate 30 on the right side of crossbow stock 10 and the second body plate 30 on the left side of crossbow stock 10. Body plates 30 form the central structure or "skeleton" of crossbow stock 10 onto which other components are affixed. For example, pistol grip 12, foregrip 14, butt plate 16, cheek rest 18, and thumb grip 20 are each affixed (directly or indirectly) to body plates 30. In another embodiment, the central structure or "skeleton" of crossbow stock 10 is formed of a single, integrally-formed body plate generally extending from forward end 22 to butt plate 16. The single body plate has the same features and the same general shape as the assembly of the two body plates 30 described herein and shown in FIG. 2. In this embodiment, components, such as pistol grip 12, foregrip 14, butt plate 16, cheek rest 18, and thumb grip 20, are each affixed (directly or indirectly) to the single body plate. In both embodiments, the single body plate or each of the two body plates 30 may be formed of an extruded metal member or a molded polymer member having any shape (e.g., flat or rounded) with any width or thickness. For example, body plates 30 may be formed of two half-shell members.

The vibration dampening system includes one or more central dampeners engaging both body plates 30 (or the single body plate) to reduce the vibration transmitted through body plates 30 when the crossbow is fired. The vibration dampening system also includes one or more component dampeners engaging components of crossbow stock 10 that are affixed to body plates 30 (e.g., pistol grip 12, foregrip 14, butt plate 16, cheek rest 18, and thumb grip 20) or the single body plate. The component dampeners reduce the vibration transmitted through the corresponding component to user (e.g., the user's hand, shoulder, or face). In other words, the components are vibration isolated.

Figure 5:
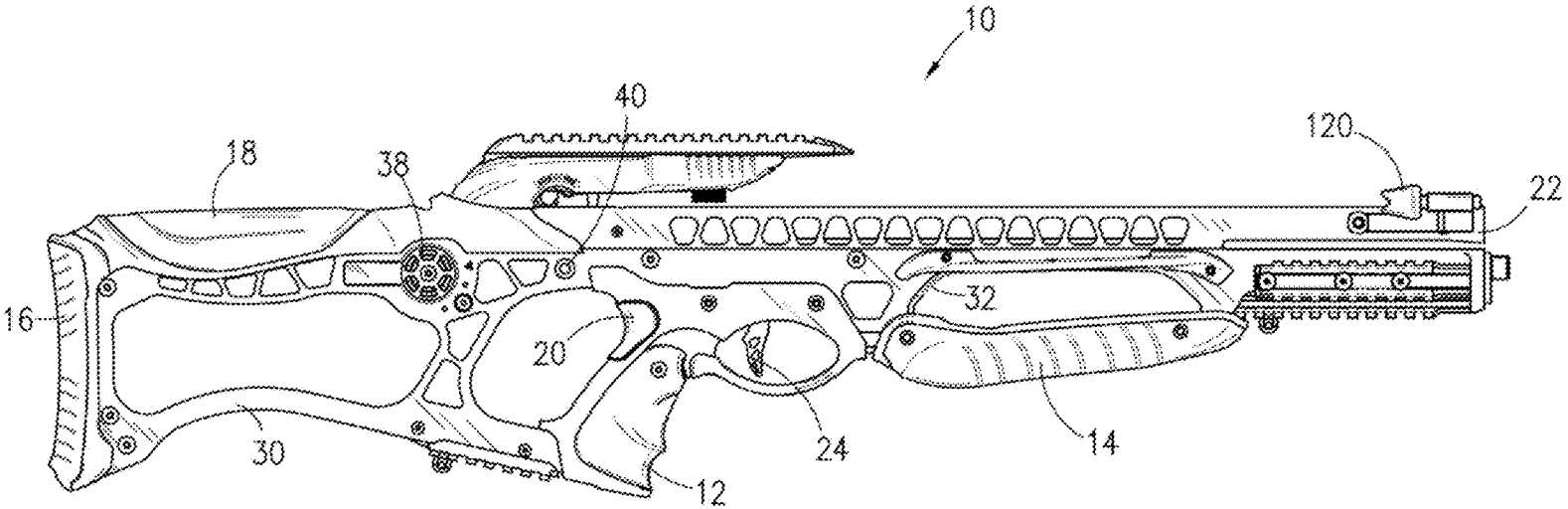
FIG. 5 is a side view of the crossbow stock with the vibration dampening system.
Figure 6:
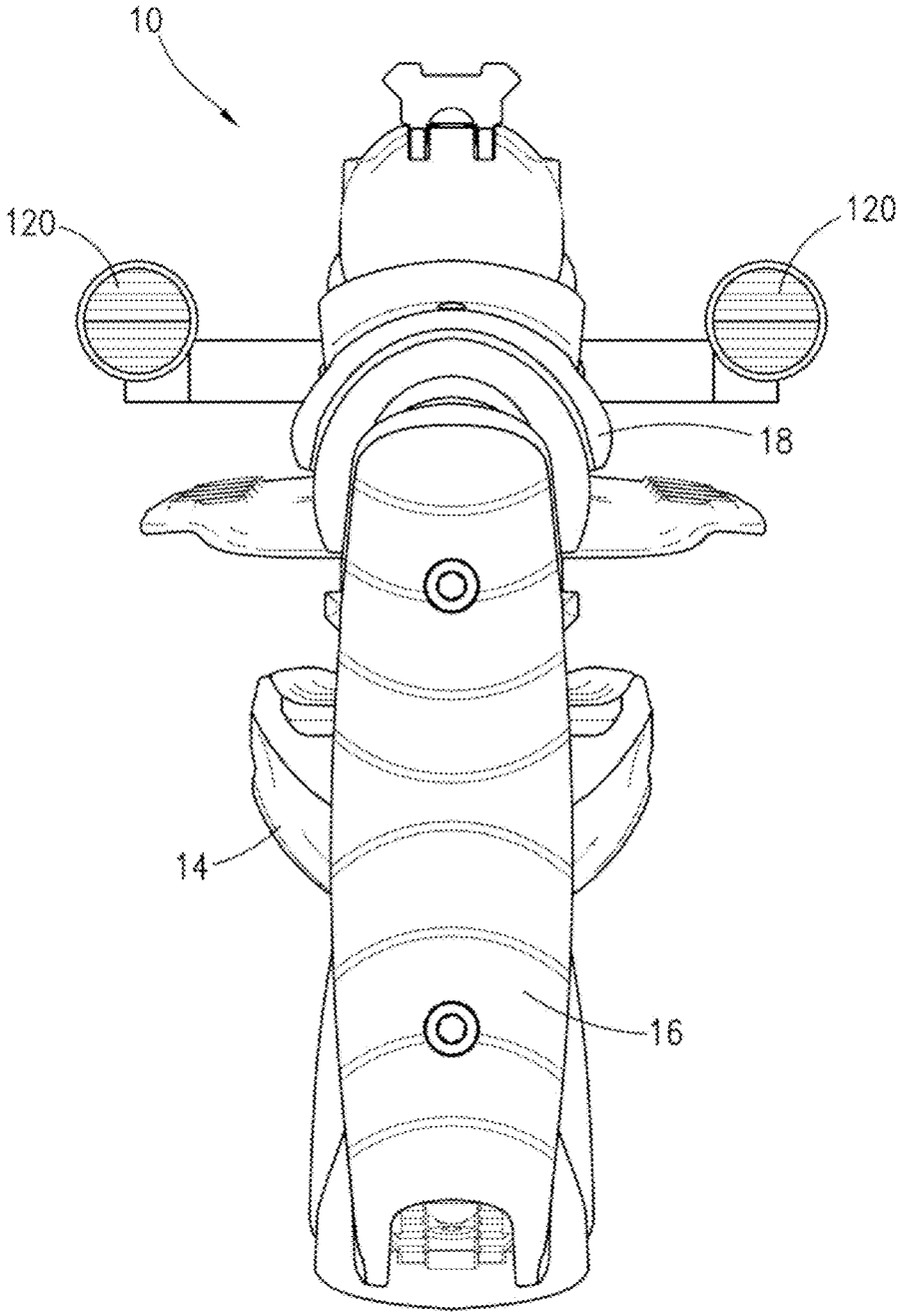
FIG. 6 is a rear view of the crossbow stock with the vibration dampening system.
Figure 7:
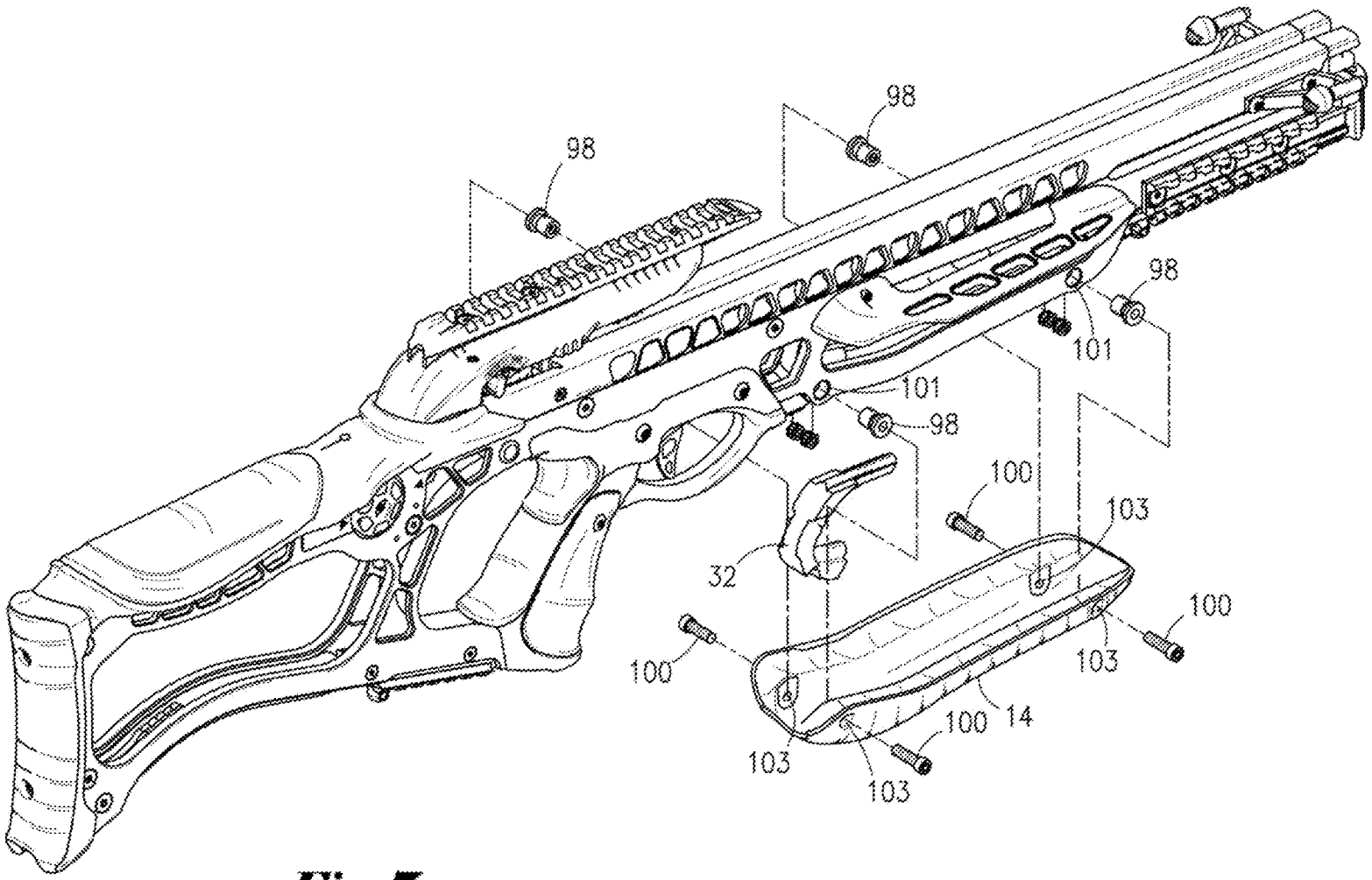
FIG. 7 is a partial exploded view of the crossbow stock with the vibration dampening system showing components of a foregrip area of the crossbow stock.
Figure 8:
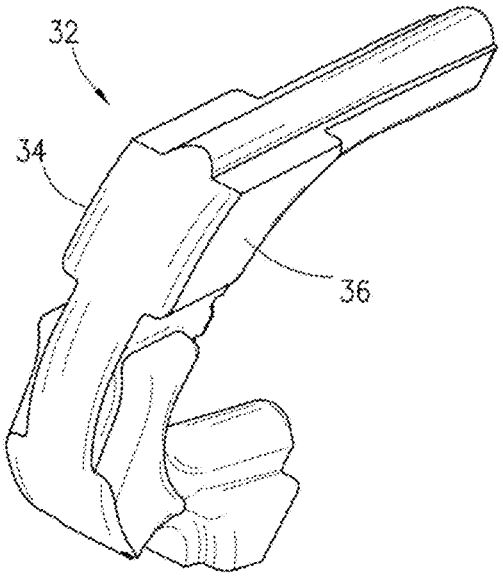
FIG. 8 is a perspective view of a first central dampener of the vibration dampening system.
Figure 9:
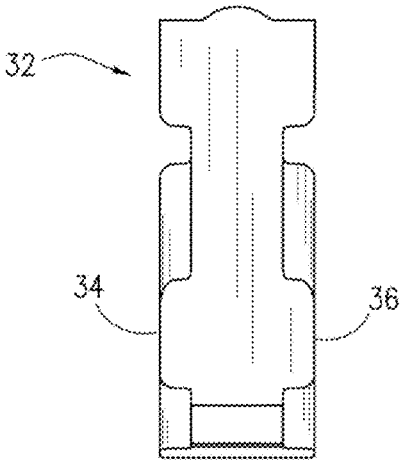
FIG. 9 is a rear view of the first central dampener.
Figure 10:
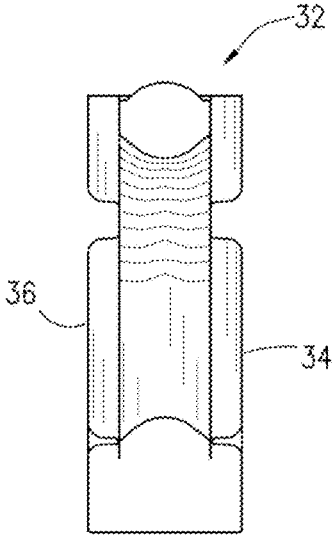
FIG. 10 is a bottom view of the first central dampener.
Figure 11:
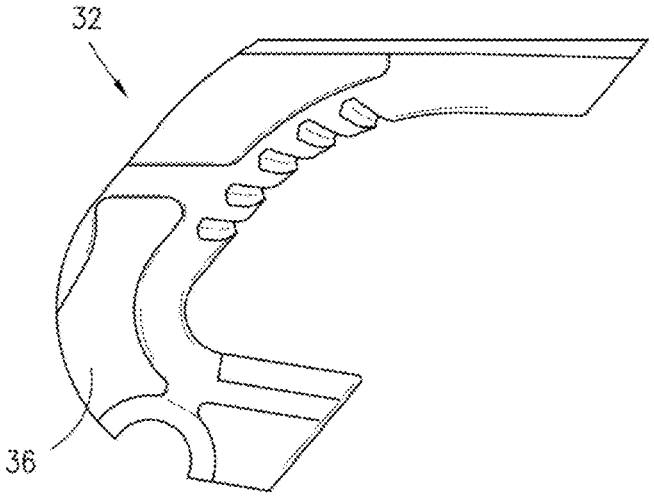
FIG. 11 is a side view of the first central dampener.
Figure 12:
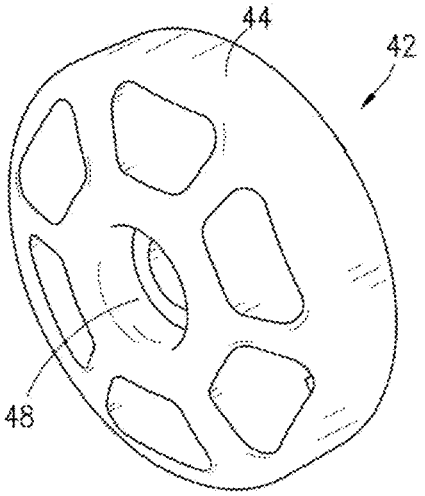
FIG. 12 is a front perspective view of a second central dampener of the vibration dampening system.
Figure 13:
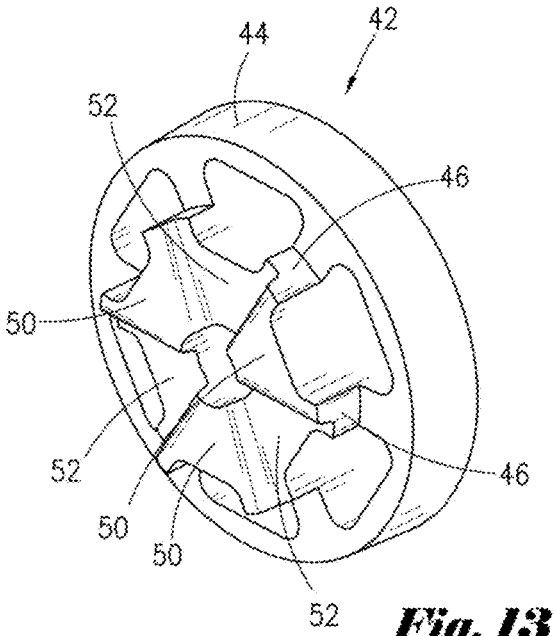
FIG. 13 is a rear perspective view of the second central dampener.
Figure 14:
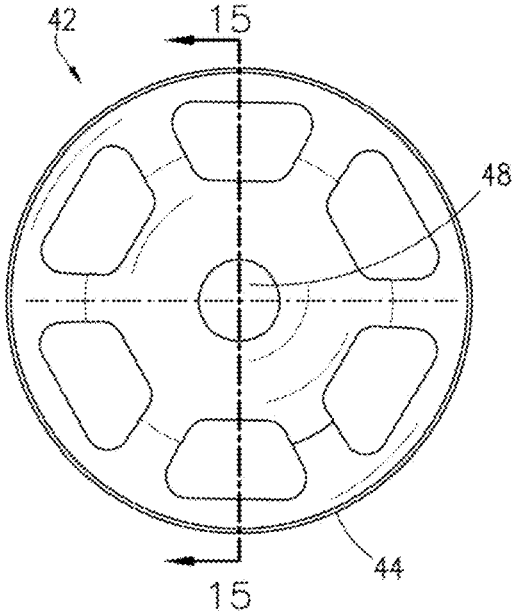
FIG. 14 is a rear view of the second central dampener.
Figure 15:
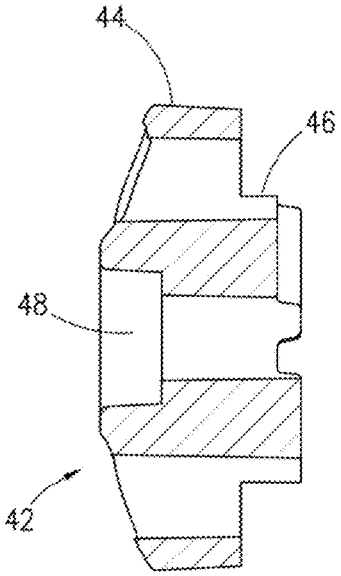
FIG. 15 is a cross-sectional view of the second central dampener taken along line 15-15 in FIG. 14.

With reference to FIGS. 5 and 7, vibration dampening system may include first central dampener 32 engaging body plates 30 or the single body plate near foregrip 14. With reference to FIGS. 8-11, first central dampener 32 includes a curved shape, generally in a C-shape. In one embodiment, first central dampener 32 is secured between body plates 30 such that first side 34 engages one body plate 30, while second side 36 engages the second body plate 30. In this embodiment, first central dampener 32 may be friction fit between body plates 30. In another embodiment, first central dampener 32 is secured to the single body plate.

Figure 16:
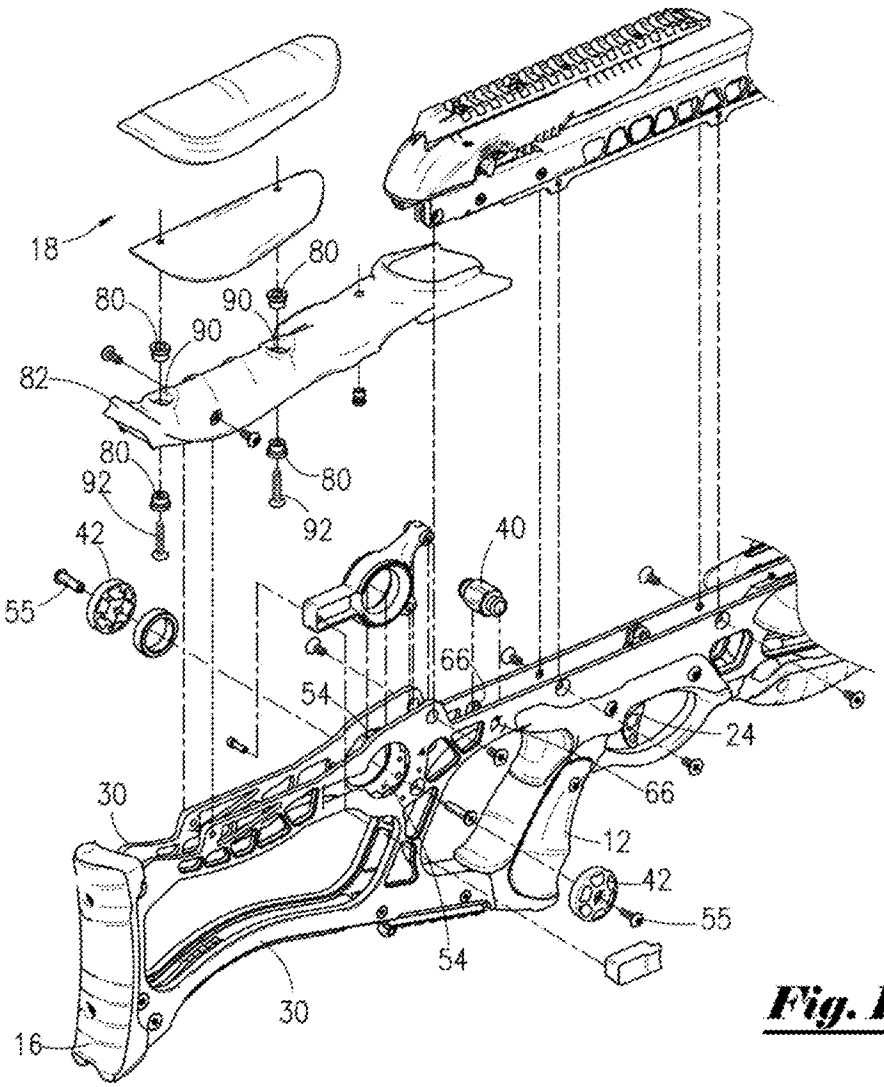
FIG. 16 is a partial exploded view of the crossbow stock with the vibration dampening system showing components of a cheek rest area and a crank cocking device (CCD) area of the crossbow stock.

Referring again to FIG. 5, vibration dampening system may include second central dampener 38 and third central dampener 40 engaging body plates 30 or the single body plate in a crank cocking device (CCD) area of crossbow stock 10. With reference to FIGS. 12-15, second central dampener 38 may be formed of two dampener components 42. Each dampener component 42 may include forward portion 44 and rearward portion 46 with central bore 48 extending through forward and rearward portions 44 and 46. Rearward portion 46 includes two lobe extensions 50 and two recessed areas 52 between the lobe extensions 50. Each of lobe extensions 50 and recessed areas 52 may have a wedge shape. With reference to FIGS. 16-17B, second central dampener 38 is secured to body plates 30 or the single body plate by positioning first dampener component 42 through opening 54 in the CCD area of body plate 30 or the single body plate on the right side of crossbow stock 10 and positioning second dampener component 42 through opening 54 in the CCD area of body plate 30 or the single body plate on the left side of crossbow stock 10. The two dampener components 42 are rotated such that lobe extensions 50 of the first dampener component 42 engages recessed areas 52 of the second dampener component 42. In one embodiment, bolt 55 is positioned through the central bore 48 of each dampener component 42, with the internal ends of each of the two bolts 55 engaging one another (e.g., male/female thread arrangement). In another embodiment, a single bolt 55 may be positioned through central bore 48 of both dampener components 42. In this way, second central dampener 38 is secured to body plates 30 or the single body plate of crossbow stock 10.

With reference to FIGS. 18-21, third central dampener 40 is elongated with expanded central portion 56, first end shoulder 58, second end shoulder 60, circumferential groove 62 between first end shoulder 58 and expanded central portion 56, and circumferential groove 64 between expanded central portion 56 and second end shoulder 60. As shown in FIGS. 16-17B, third central dampener 40 is secured to body plates 30 by positioning central portion 56 between body plates 30 with grooves 62 and 64 engaging openings 66 in the CCD area of each body plate 30 such that first end shoulder 58 extends beyond one body plate 30 and second end shoulder 60 extends beyond the second body plate 30. In this way, third central dampener 40 may be friction fit between body plates 30 of crossbow stock 10. In another embodiment, third central dampener 40 is formed of a material having a flexibility suitable for inserting third central dampener 40 through openings 66 in the CCD area of the single body plate of crossbow stock 10. In this embodiment, third central dampener 40 may be inserted into one end of opening 66 to position first end shoulder 58 and second end shoulder 60 at the ends of opening 66.

Second central dampener 38 may be removed by a user in order to secure a portion of a crank cocking device [not shown] within opening 54 of crossbow stock 10. Even without second central dampener 38 in place, a significant vibration reducing effect is accomplished with the vibration dampening system disclosed herein. A second portion of the crank cocking device may be secured within central bore 65 through third central dampener 40 (shown in FIGS. 18-21) positioned within openings 66 in crossbow stock 10 (shown in FIGS. 16-17B). In other words, the crank cocking device is accommodated without removing third central dampener 40 from crossbow stock 10.

First, second, and third central dampeners 32, 38, and 40 each reduces the vibration transmitted through body plates 30 or the single body plate of crossbow stock 10.

Figure 22:
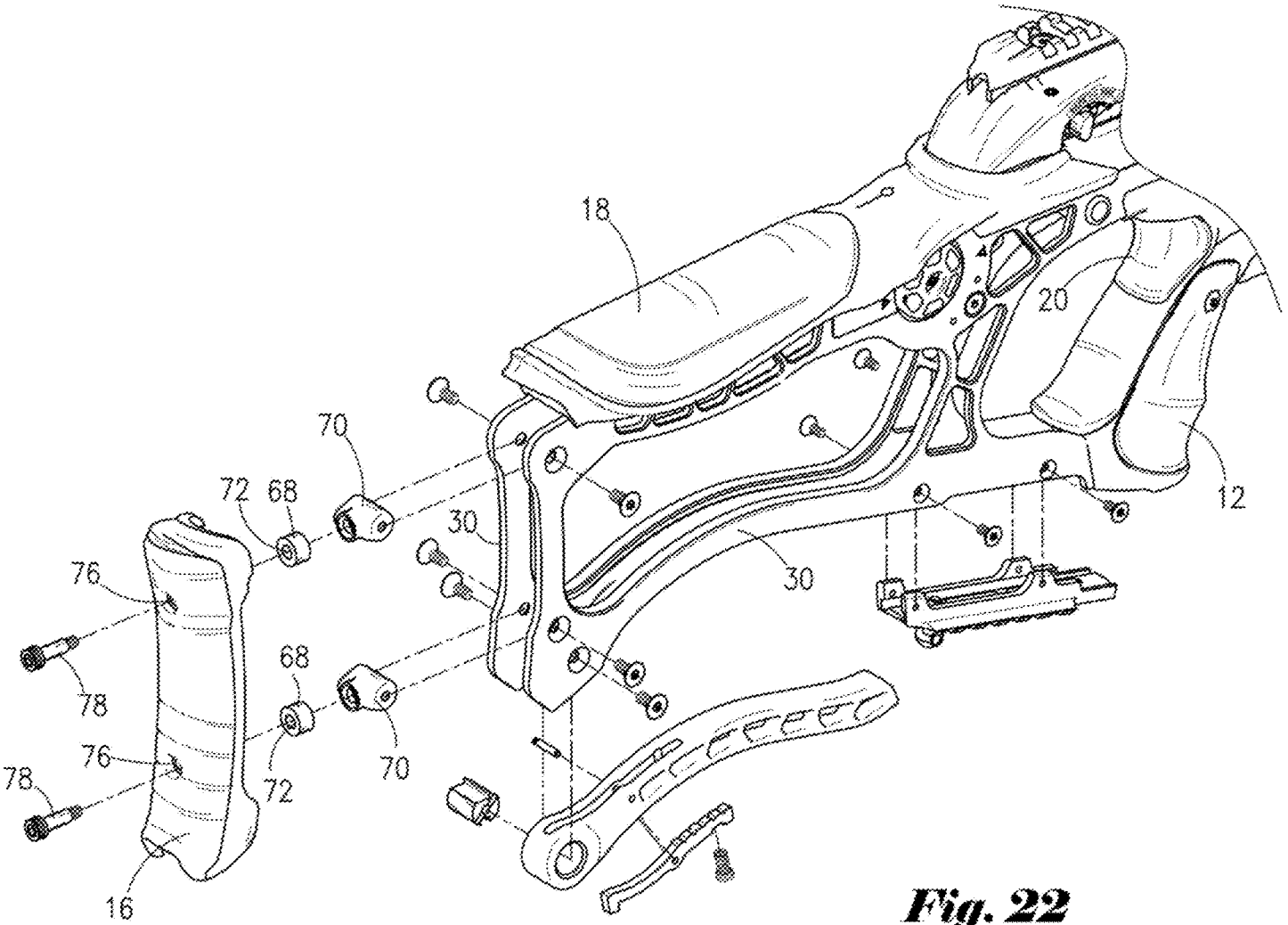
FIG. 22 is a partial exploded view of the crossbow stock with the vibration dampening system showing components of the butt plate area of the crossbow stock.
Figure 23:
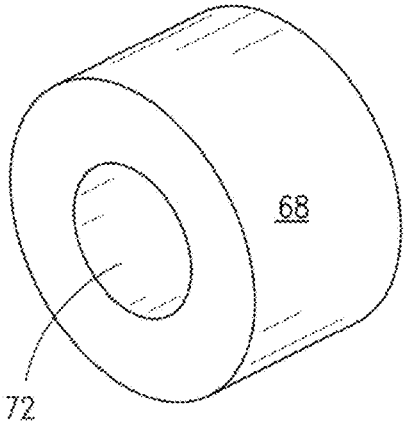
FIG. 23 is a front perspective view of a first component dampener of the vibration dampening system.
Figure 24:
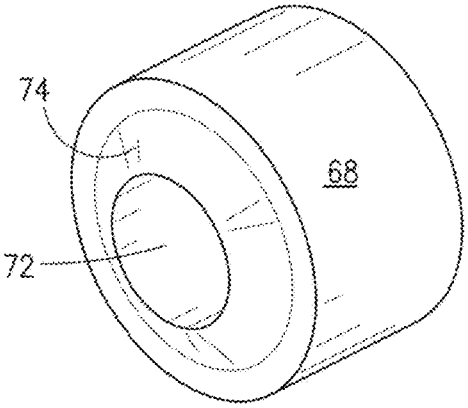
FIG. 24 is a rear perspective view of the first component dampener.
Figure 25:
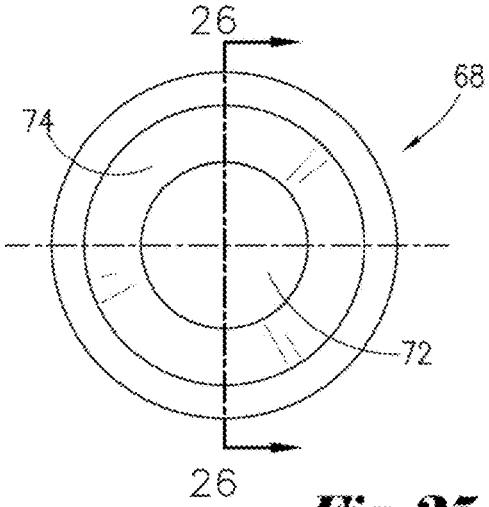
FIG. 25 is a rear view of the first component dampener.
Figure 26:
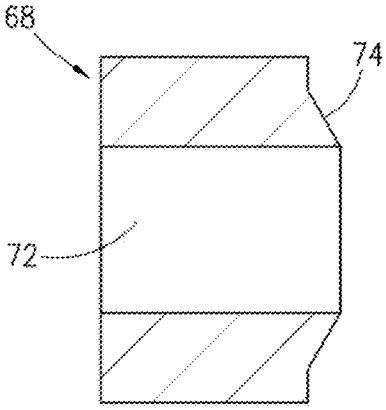
FIG. 26 is a cross-sectional view of the first component dampener taken along line 26-26 in FIG. 25.

Referring now to FIG. 22, the vibration dampening system may include one or more first component dampeners 68 each secured to an axis member 70, which is positioned between body plates 30 adjacent butt plate 16. As shown in FIGS. 23-26, first component dampener 68 has a generally tubular shape including central bore 72 and rear tapered portion 74. With reference again to FIG. 22, each axis member 70 may be secured between body plates 30, such as with bolts or screws as shown. Rear tapered portion 74 of each first component dampener 68 may engage axis member 70, and butt plate 16 may be positioned over first component dampeners 68 such that apertures 76 of butt plate 16 are aligned with central bore 72 of each first component dampener 68. Screws 78 may then be secured through apertures 76 to secure butt plate 16 to axis member 70 through first component dampener 68. In this way, first component dampener 68 is secured between body plates 30 and butt plate 16 to reduce the vibration transmitted from body plate 30 to butt plate 16 (i.e., to isolate butt plate 16). In another embodiment, rear tapered portion 74 of first component dampeners 68 may engage the single body plate or an axis member attached to the single body plate, and butt plate 16 may be positioned over first component dampeners 68 such that apertures 76 of butt plate 16 are aligned with central bore 72 of each first component dampener 68. In this embodiment, screws 78 may then be secured through apertures 76 to secure butt plate 16 to the single body plate through first component dampeners 68, thereby reducing the vibration transmitted from the single body plate to butt plate 16 (i.e., to isolate butt plate 16).

Figure 17A:
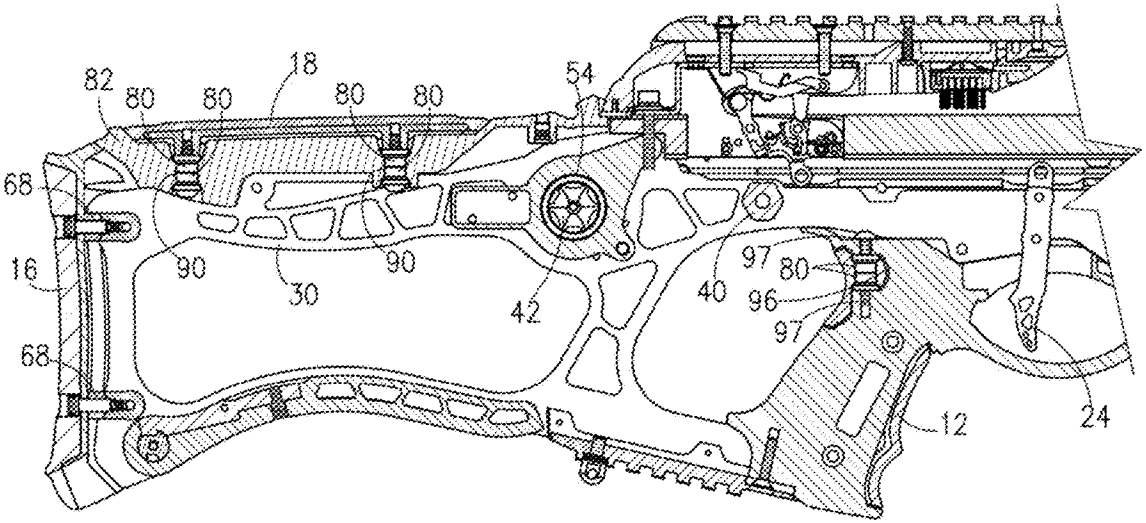
FIGS. 17A and 17B are cross-sectional views of the crossbow stock with the vibration dampening system taken along line 17-17 in FIG. 3.
Figure 17B:
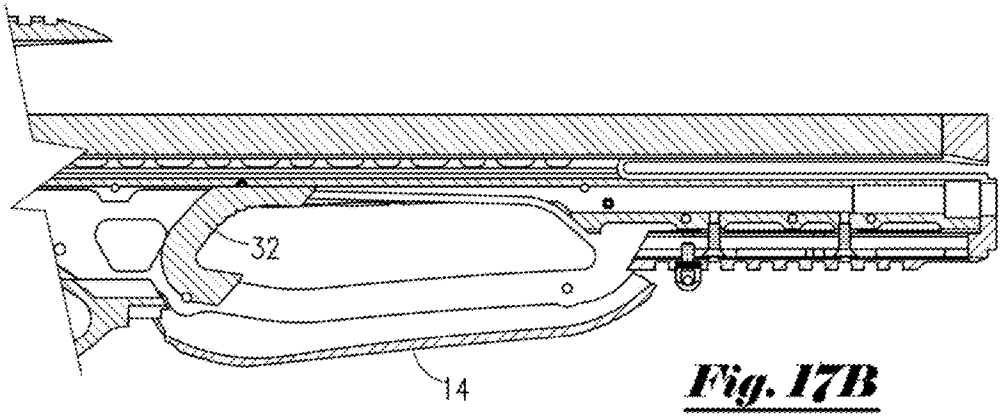
Figure 19:
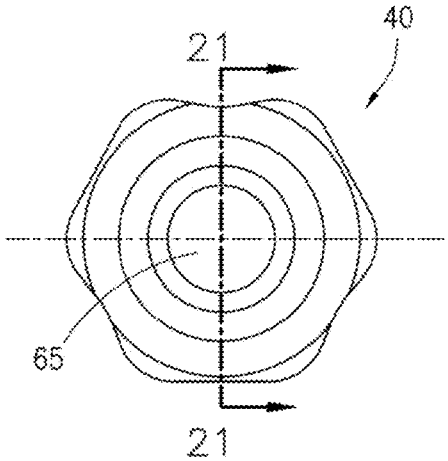
FIG. 19 is a front view of the third central dampener.
Figure 18:
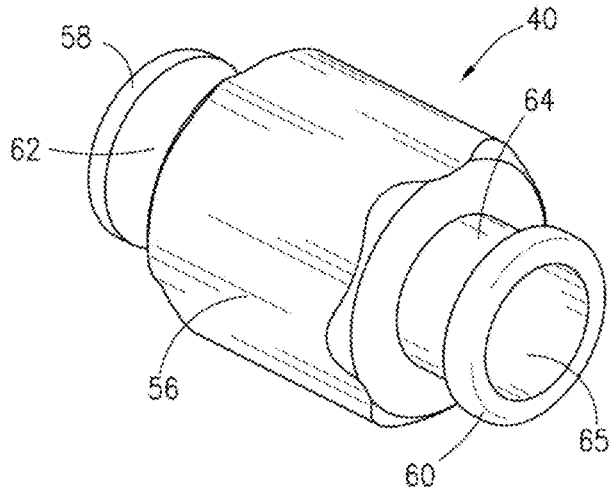
FIG. 18 is a perspective view of a third central dampener of the vibration dampening system.
Figure 20:
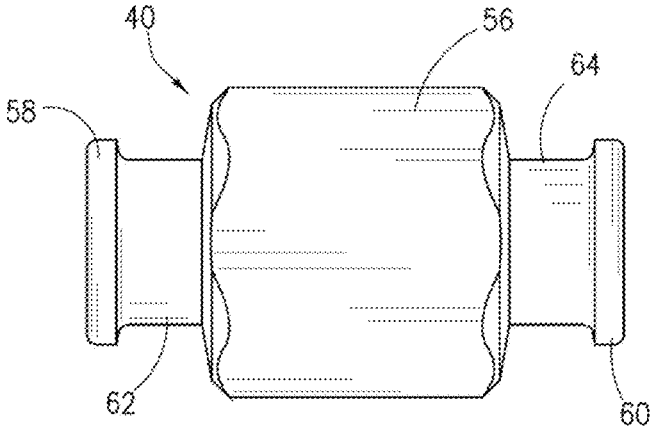
FIG. 20 is a side view of the third central dampener.
Figure 21:
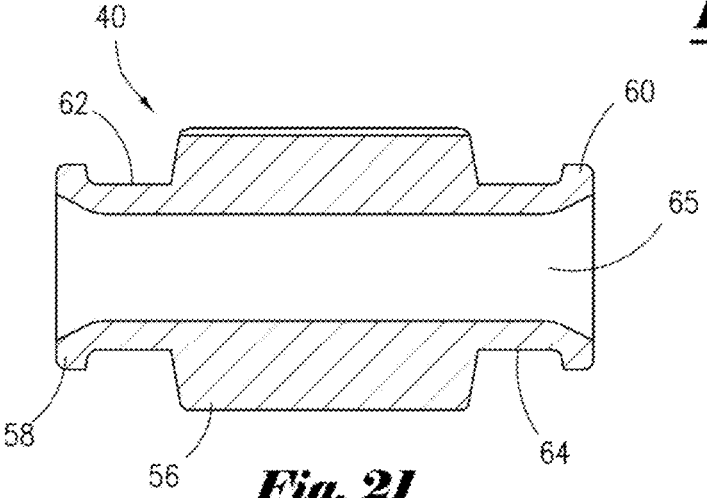
FIG. 21 is a cross-sectional view of the third central dampener taken along line 21-21 in FIG. 19.
Figure 27:
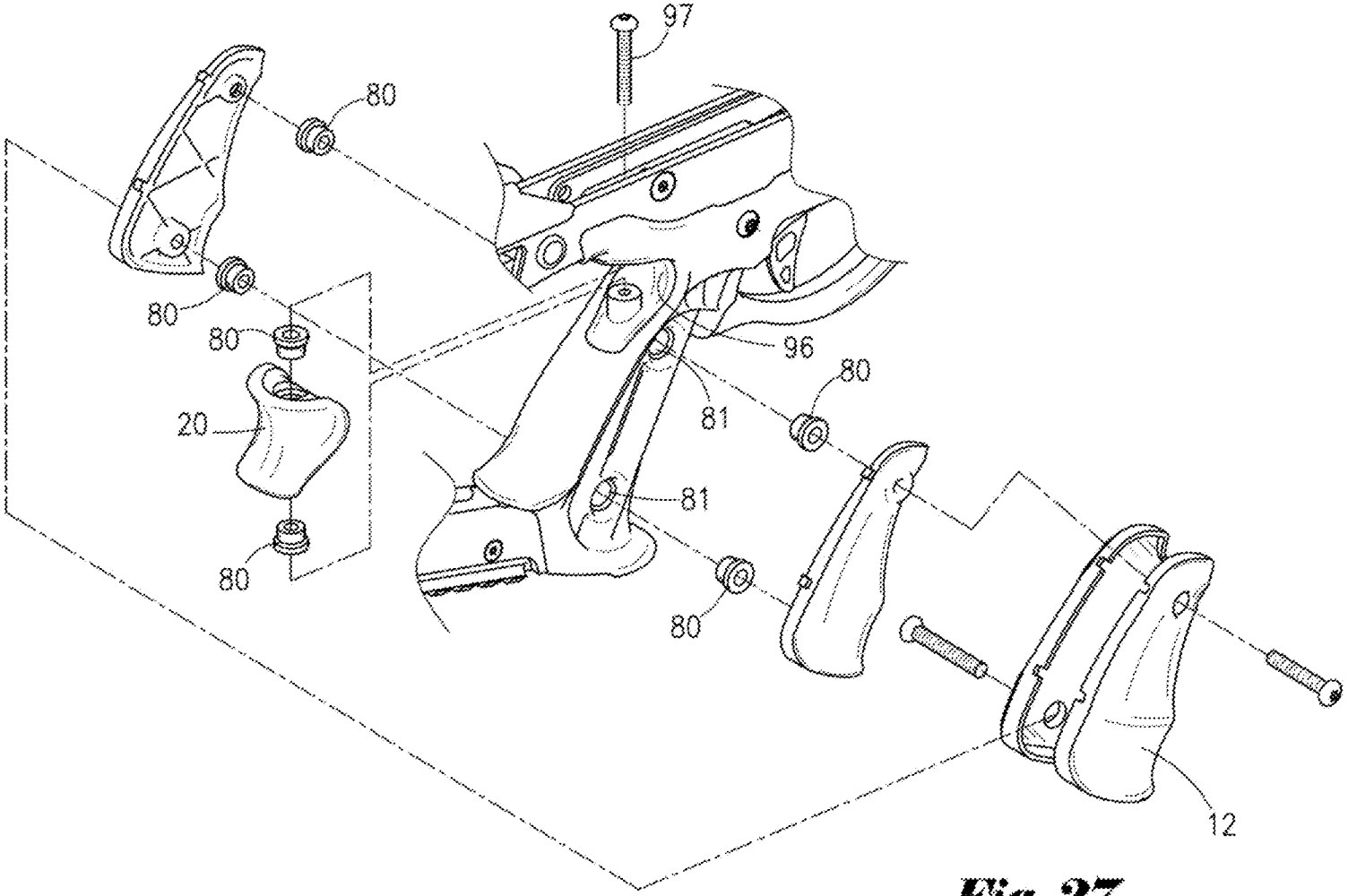
FIG. 27 is a partial perspective view of the crossbow stock with the vibration dampening system showing components of the pistol grip area of the crossbow stock.
Figure 28:
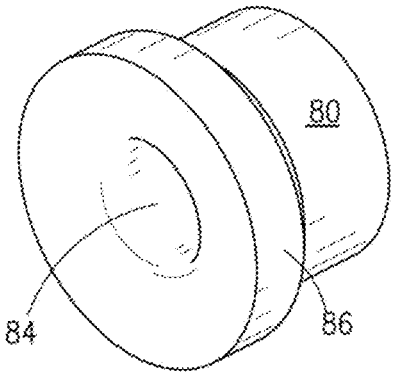
FIG. 28 is a front perspective view of a second component dampener of the vibration dampening system.
Figure 29:
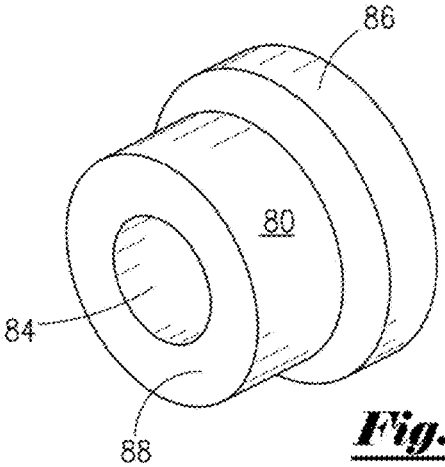
FIG. 29 is a rear perspective view of the second component dampener.
Figure 30:
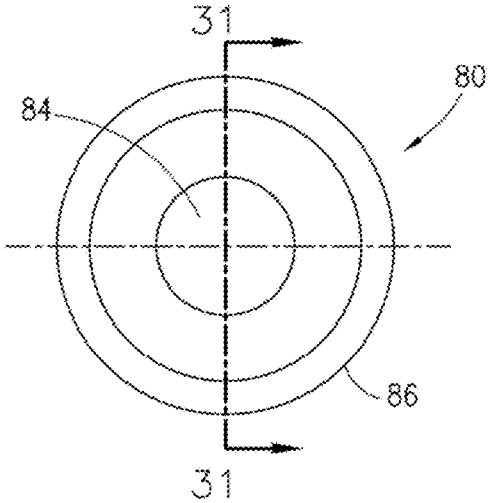
FIG. 30 is a rear view of the second component dampener.
Figure 31:
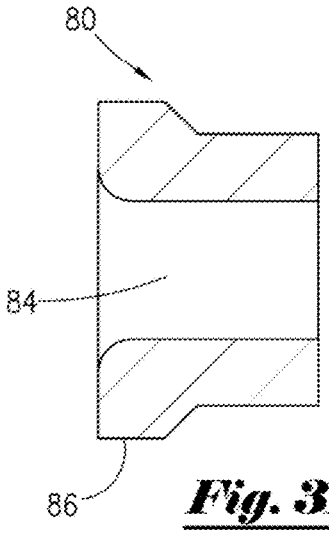
FIG. 31 is a cross-sectional view of the second component dampener taken along line 31-31 in FIG. 30.
Figure 32:
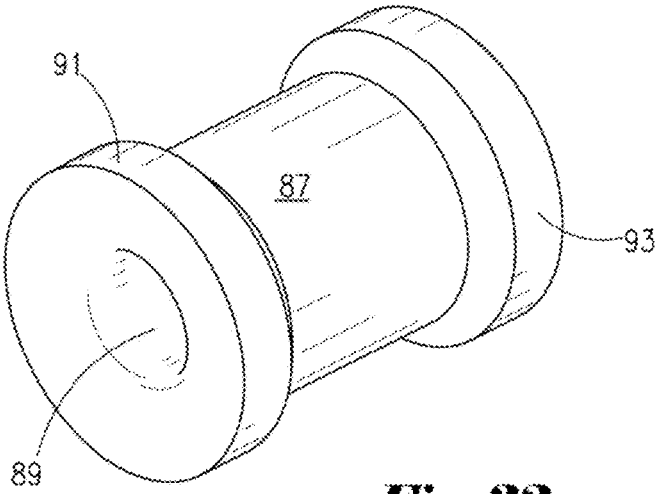
FIG. 32 is a perspective view of an alternate embodiment of the second component dampener.
Figure 33:
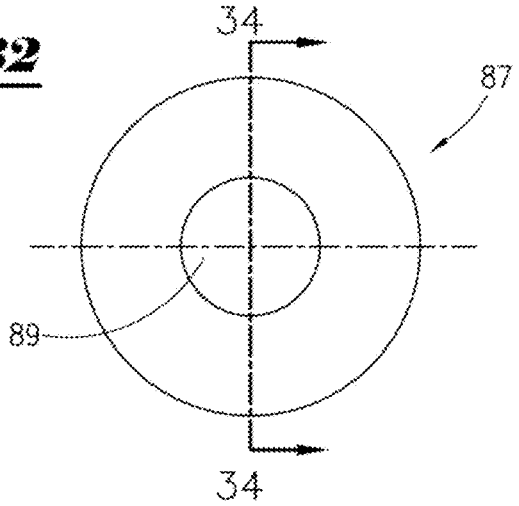
FIG. 33 is a front view of the alternate embodiment of the second component dampener.
Figure 34:
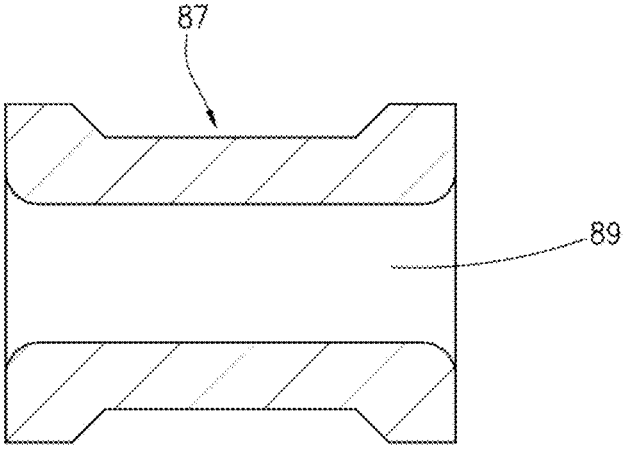
FIG. 34 is a cross-sectional view of the alternate embodiment of the second component dampener taken along line 34-34 in FIG. 33.
Figure 35:
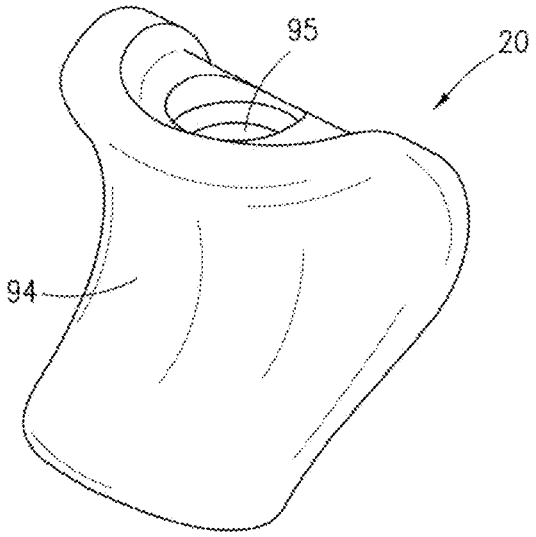
FIG. 35 is a front perspective view of a thumb grip of the crossbow stock.
Figure 36:
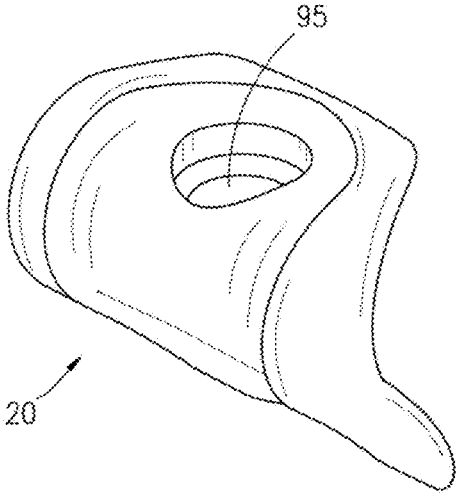
FIG. 36 is a rear perspective view of the thumb grip.
Figure 37:
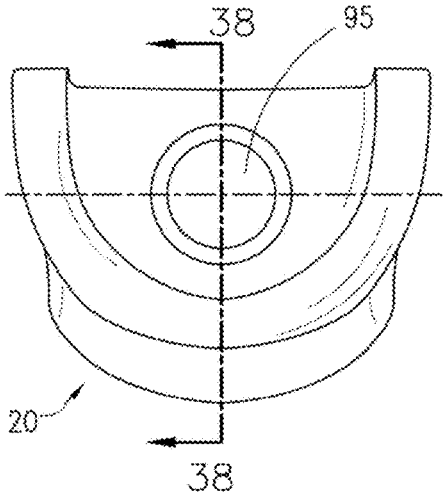
FIG. 37 is a top view of the thumb grip.
Figure 38:
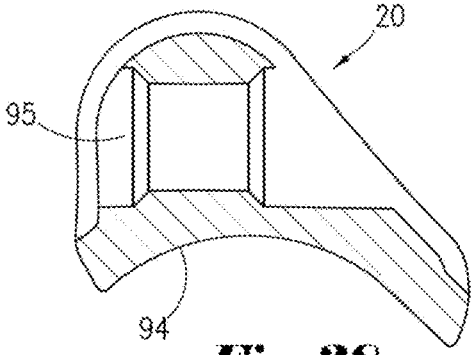
FIG. 38 is a cross-sectional view of the thumb grip taken along line 38-38 in FIG. 37.
Figure 39:
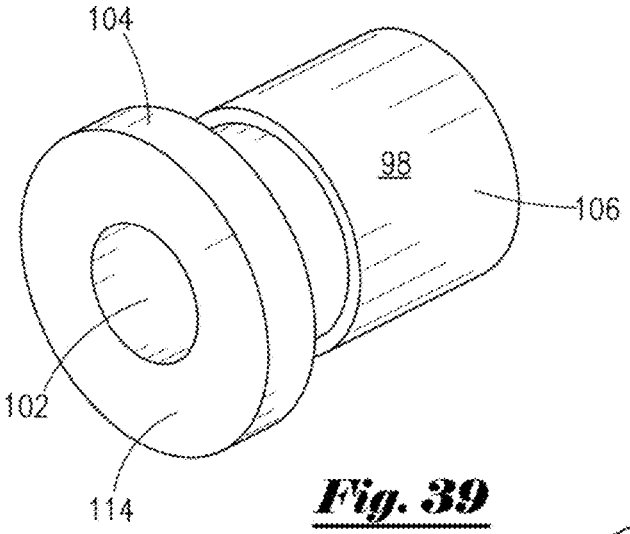
FIG. 39 is a front perspective view of a third component dampener of the vibration dampening system.
Figure 40:
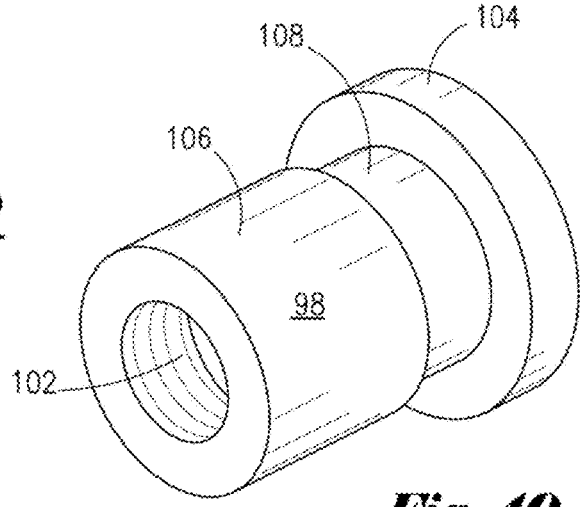
FIG. 40 is a rear perspective view of the third component dampener.
Figure 41:
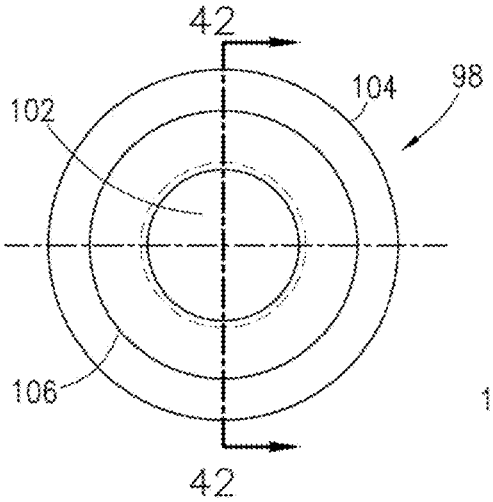
FIG. 41 is a rear view of the third component dampener.
Figure 42:
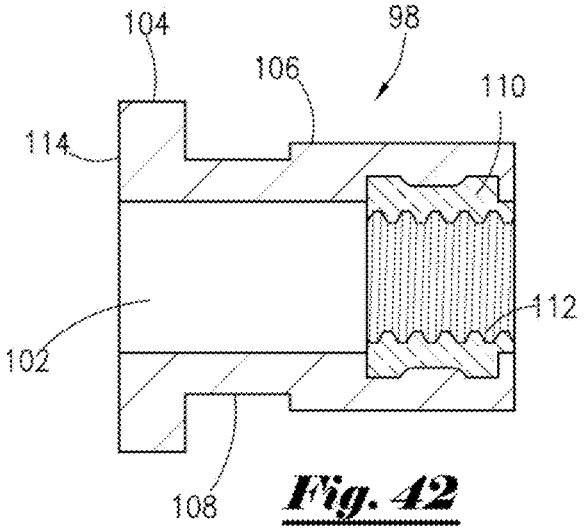
FIG. 42 is a cross-sectional view of the third component dampener taken along line 42-42 in FIG. 41.

Vibration dampening system may also include one or more second component dampeners 80 secured, in sets of two, to pistol grip 12, thumb grip 20, and base portion 82 of cheek rest 18 (as shown in FIGS. 16, 17A, and 27). As shown in FIGS. 28-31, each second component dampener 80 has a generally tubular shape including central bore 84 and outer shoulder 86. Second component dampeners 80 may be used in sets of two, such that rearward ends 88 of both dampeners 80 are in contact and central bores 84 of both dampeners 80 are aligned. With reference to FIG. 27, second component dampeners 80 may be positioned within one or more apertures 81 of the pistol grip area of crossbow stock 10. Pistol grip 12 may be positioned over the pistol grip area of crossbow stock 10, then a screw or bolt may be positioned through apertures of pistol grip 12 and through the central bores 84 of each of the dampeners 80 to secure dampeners 80 within the apertures 81. Referring now to FIGS. 16-17A, second component dampeners 80 may also be positioned within one or more apertures 90 within base portion 82 of cheek rest 18. A screw 92 may then be positioned through the central bores 84 of each of the dampeners 80 to secure dampeners 80 within apertures 90. Screws 92 may be used to secure cheek rest 18 to base portion 82. In these ways, second component dampeners 80 are secured to cheek rest 18 and pistol grip 12 to reduce the vibration transmitted from body plate 30 to cheek rest 18 and pistol grip 12, respectively (i.e., to isolate cheek rest 18 and pistol grip 12). FIGS. 32-34 illustrate an alternate embodiment of the second component dampener. Second component dampener 87 has a generally tubular shape including central bore 89, first outer shoulder 91, and second outer shoulder 93. Second component dampeners 87 may be secured within one or more apertures 81 of the pistol grip area of crossbow stock 10 by inserting second component dampeners 87 through apertures 81, and positioning a screw through the central bore 89 of each of the dampeners 87. Similarly, second component dampeners 87 may be secured within one or more apertures 90 within base portion 82 of cheek rest 18 by inserting second component dampeners 87 through apertures 90, and positioning a screw 92 through central bore 89 of each of the dampeners 87 to secure dampeners 87 within apertures 90 and to secure cheek rest 18 to base portion 82. As described, second component dampeners 87 may also be secured to cheek rest 18 and pistol grip 12 to reduce the vibration transmitted from the single body plate to cheek rest 18 and pistol grip 12, respectively (i.e., to isolate cheek rest 18 and pistol grip 12 from the single body plate).

Referring now to 35-38, thumb grip 20 disclosed herein may include grip surface 94 that has a generally concave shape. A user's thumb, or an area between a user's thumb and forefinger, may engage grip surface 94 during use of the crossbow. Thumb grip 20 may also include central bore 95. With reference again to FIG. 27, thumb grip 20 may fit into recess 96 of crossbow stock 10 (shown in FIGS. 17A and 27) such that central bore 95 of thumb grip 20 is aligned with aperture 97 through the surface of the molded pistol grip 12 of the crossbow stock 10 (as shown in FIG. 17A). Two second component dampeners 80 may be positioned within central bore 95 of thumb grip 20. A screw may then be secured through central bores 84 of both dampeners 80, thereby securing thumb grip 20 to crossbow stock 10. In this way, second component dampeners 80 are secured within thumb grip 20 to reduce the vibration transmitted from body plates 30 or the single body plate to thumb grip 20 (i.e., to isolate thumb grip 20). Alternately, second component dampener 87 may be secured within thumb grip 20 to reduce the vibration transmitted from body plates 30 or the single body plate to thumb grip 20.

With reference again to FIG. 7, the vibration dampening system may further include third component dampeners 98 secured with screws 100 between body plates 30 and foregrip 14. As shown in FIGS. 39-42, each third component dampener 98 may have a generally tubular shape including central bore 102, shoulder 104, body portion 106, and circumferential groove 108 between shoulder 104 and body portion 106. In one embodiment, third component dampener 98 may further include insert 110, which is molded into body portion 106 of dampener 98. Insert 110 may include threaded bore 112 aligned with central bore 102 of dampener 98. Threaded bore 112 may be configured to threadedly engage screw 100. In one embodiment, insert 110 is formed of a metal, such as brass, stainless steel, or coated steel.

As shown in FIG. 7, each dampener 98 may be positioned through aperture 101 in body plate 30 such that body plate 30 engages circumferential groove 108. In one embodiment, two dampeners 98 are positioned within the two apertures 101 in each of body plates 30 such that four total dampeners 98 are used. Foregrip 14 may then be positioned over body plates 30 such that apertures 103 in foregrip 14 are aligned with central bores 102 of each of third component dampeners 98. In this position, front face 114 of each dampener 98 may contact foregrip 14. Screws 100 may then be secured through the apertures 103 in foregrip 14 and central bores 102 of dampeners 98 to secure foregrip 14 to body plates 30. In this way, third component dampeners 98 (more specifically, shoulders 104 of dampeners 98) are secured between body plates 30 and foregrip 14 to reduce the vibration transmitted from body plates 30 to foregrip 14 (i.e., to isolate foregrip 14). In another embodiment, each third component dampener 98 may be positioned through aperture 101 in the single body plate such that the single body plate engages circumferential groove 108. Two dampeners 98 may be positioned within each aperture 101 in the single body plate (i.e., one dampener 98 inserted into each end of each aperture 101) such that four total dampeners 98 are used. Foregrip 14 may then be positioned over the single body plate such that apertures 103 in foregrip 14 are aligned with central bores 102 of each of third component dampeners 98. Screws 100 may be secured through apertures 103 in foregrip 14 and central bores 102 of dampeners 98 to secure foregrip 14 to the single body plate. In this way, third component dampeners 98 are secured between the single body plate and foregrip 14 to reduce the vibration transmitted from the single body plate to foregrip 14 (i.e., to isolate foregrip 14).

Figure 43:
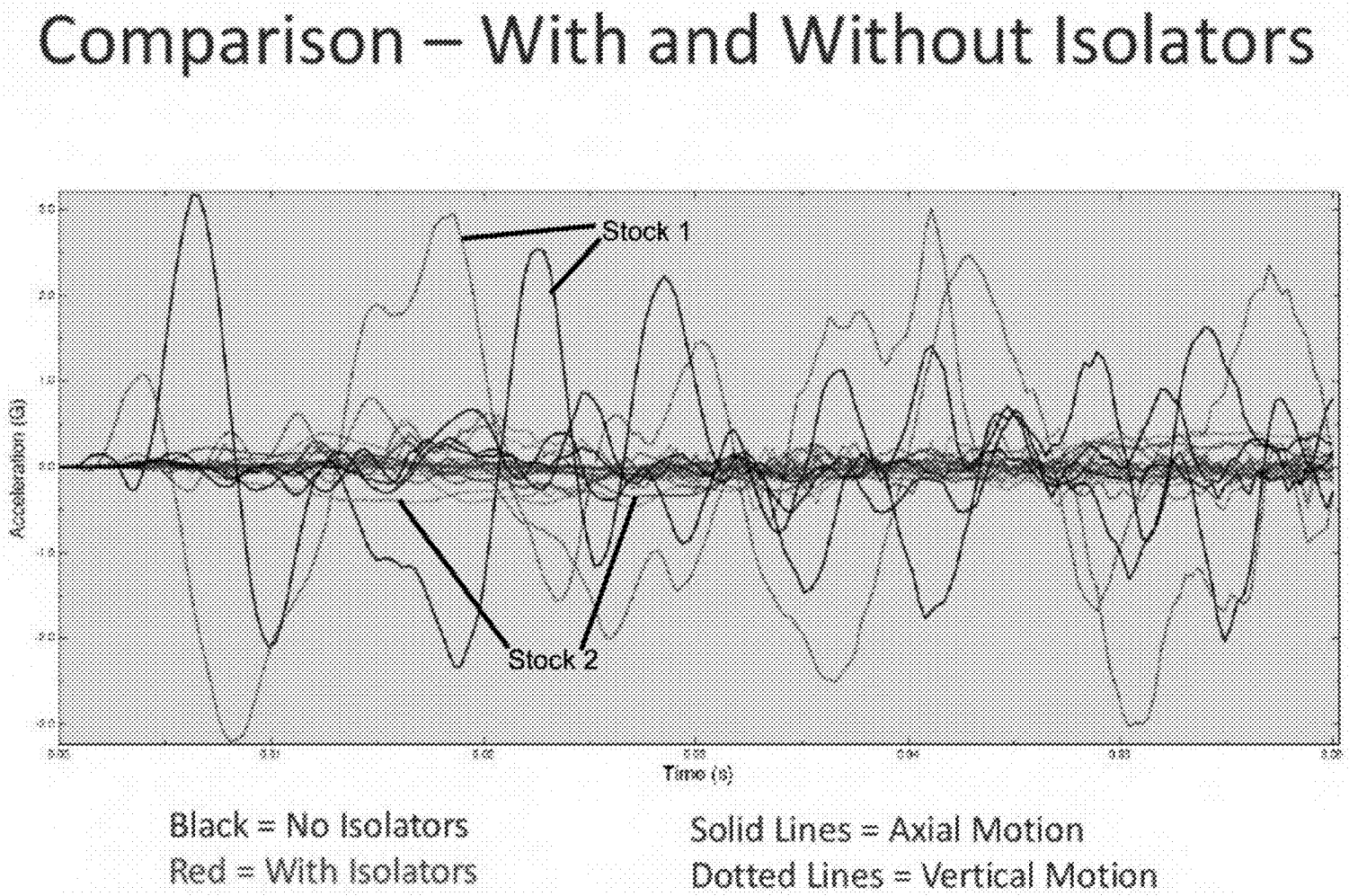
FIG. 43 is a graphical comparison of vibration felt on a crossbow stock with and without the vibration dampening system.

Vibration analysis testing was conducted on the vibration dampening system of crossbow stock 10. The vibration associated with releasing a bowstring was simulated and the resulting vibration was measured on Stock 1 including no vibration dampening system (i.e., "No Isolators") and Stock 2 including the vibration dampening system (i.e., "With Isolators"). FIG. 43 provides a graphical representation of the vibration measured in Stock 1 (waves having larger magnitudes) and the vibration measured in Stock 2 (waves having smaller magnitudes). The vibration in Stock 2 was lower than the vibration in Stock 1. Accordingly, the vibration dampening system reduced the vibration in the crossbow stock.

Figure 44:
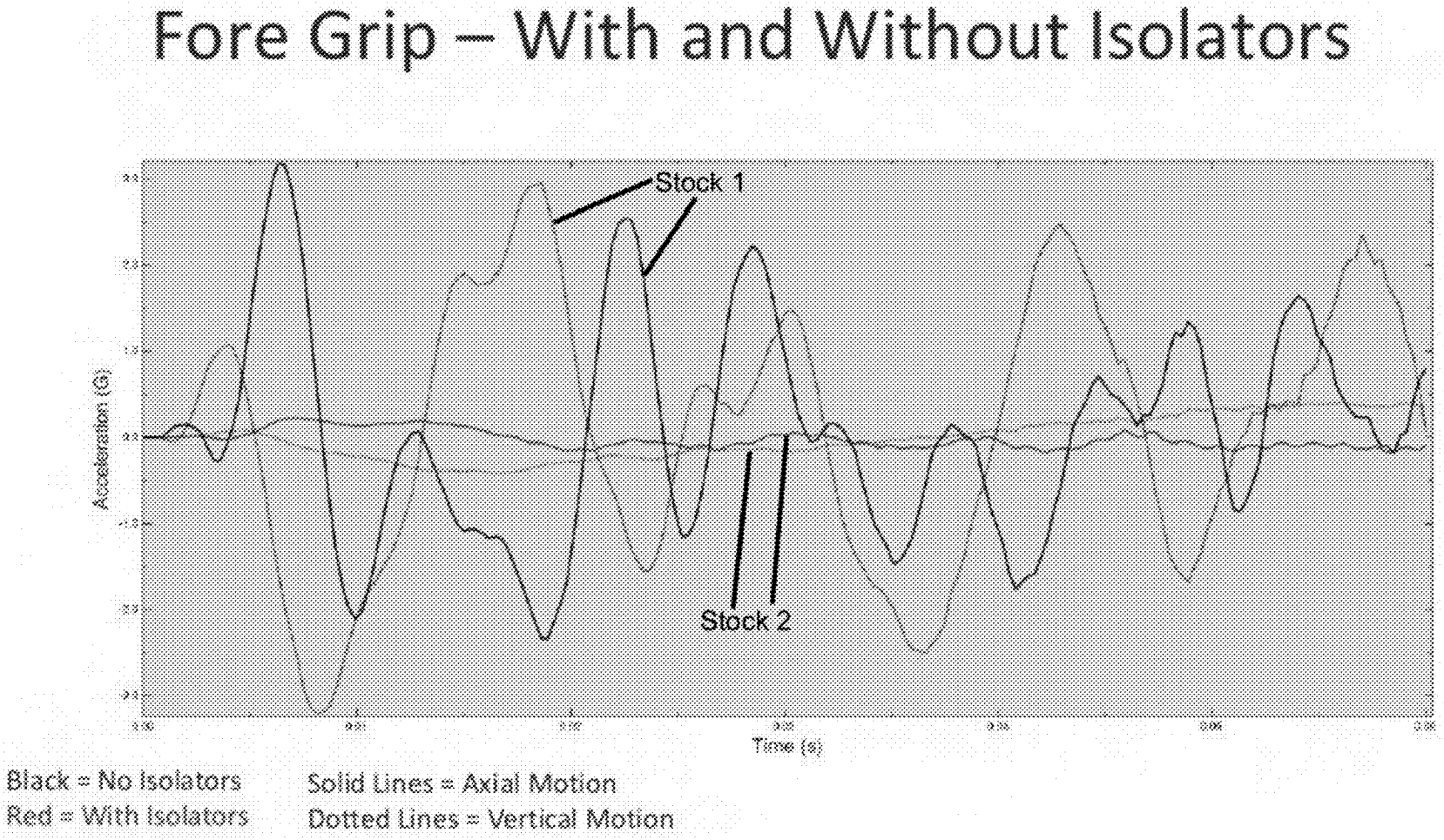
FIG. 44 is a graphical comparison of vibration felt on a foregrip of the crossbow stock with and without the vibration dampening system.

Similar vibration analysis was conducted for each component of Stock 1 and Stock 2. FIG. 44 provides a graphical representation of the vibration measured in the foregrip of Stock 1 (waves having larger magnitudes) and the vibration measured in the foregrip of Stock 2 (waves having smaller magnitudes). The vibration in the foregrip of Stock 2 was lower than the vibration in the foregrip of Stock 1. Accordingly, the vibration dampening system reduced the vibration in the foregrip of the crossbow stock by about 87%.

Figure 45:
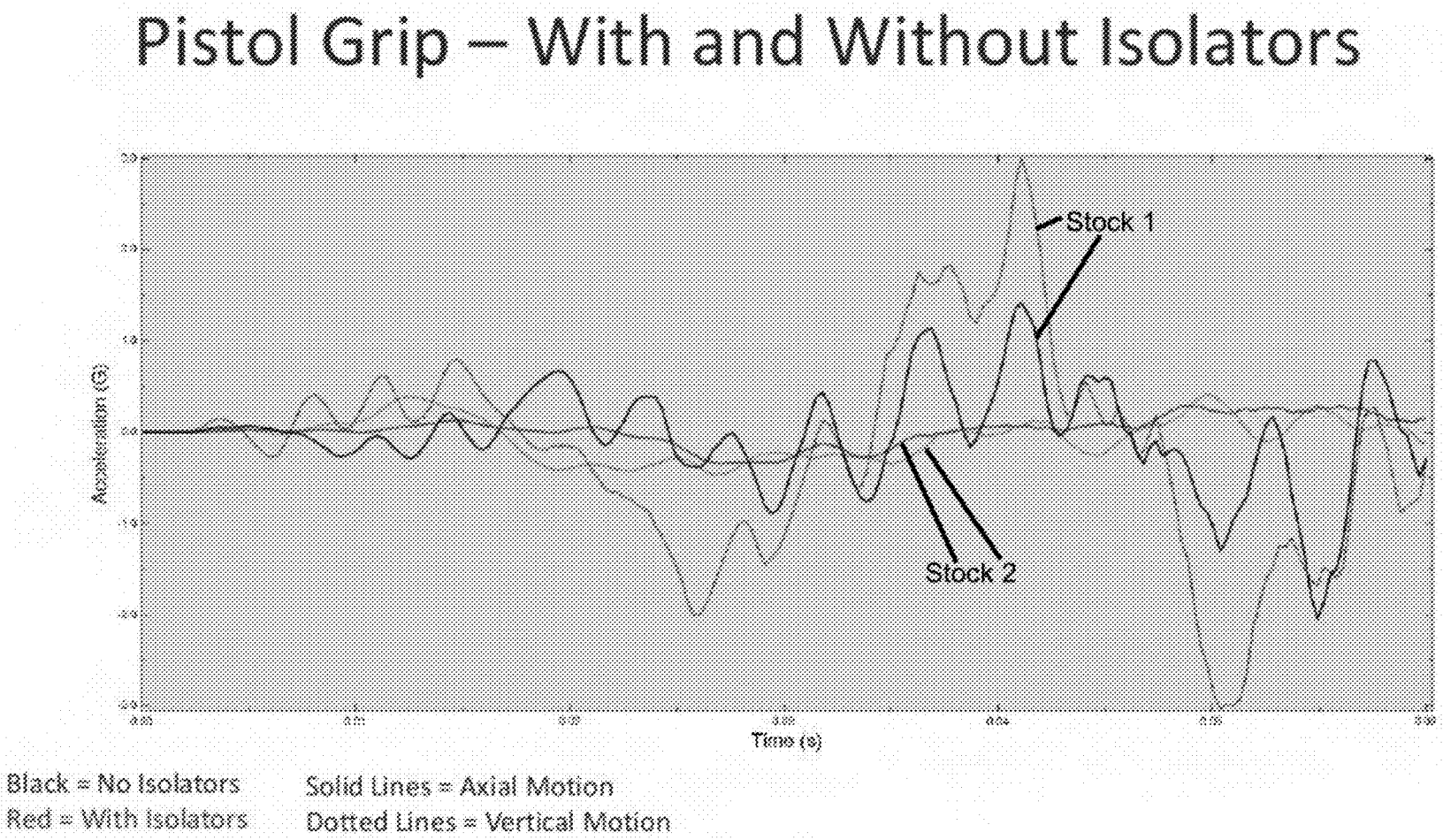
FIG. 45 is a graphical comparison of vibration felt on a pistol grip of the crossbow stock with and without the vibration dampening system.

FIG. 45 provides a graphical representation of the vibration measured in the pistol grip of Stock 1 (waves having larger magnitudes) and the vibration measured in the pistol grip of Stock 2 (waves having smaller magnitudes). The vibration in the pistol grip of Stock 2 was lower than the vibration in the pistol grip of Stock 1. Accordingly, the vibration dampening system reduced the vibration in the pistol grip of the crossbow stock by about 87%.

Figure 46:
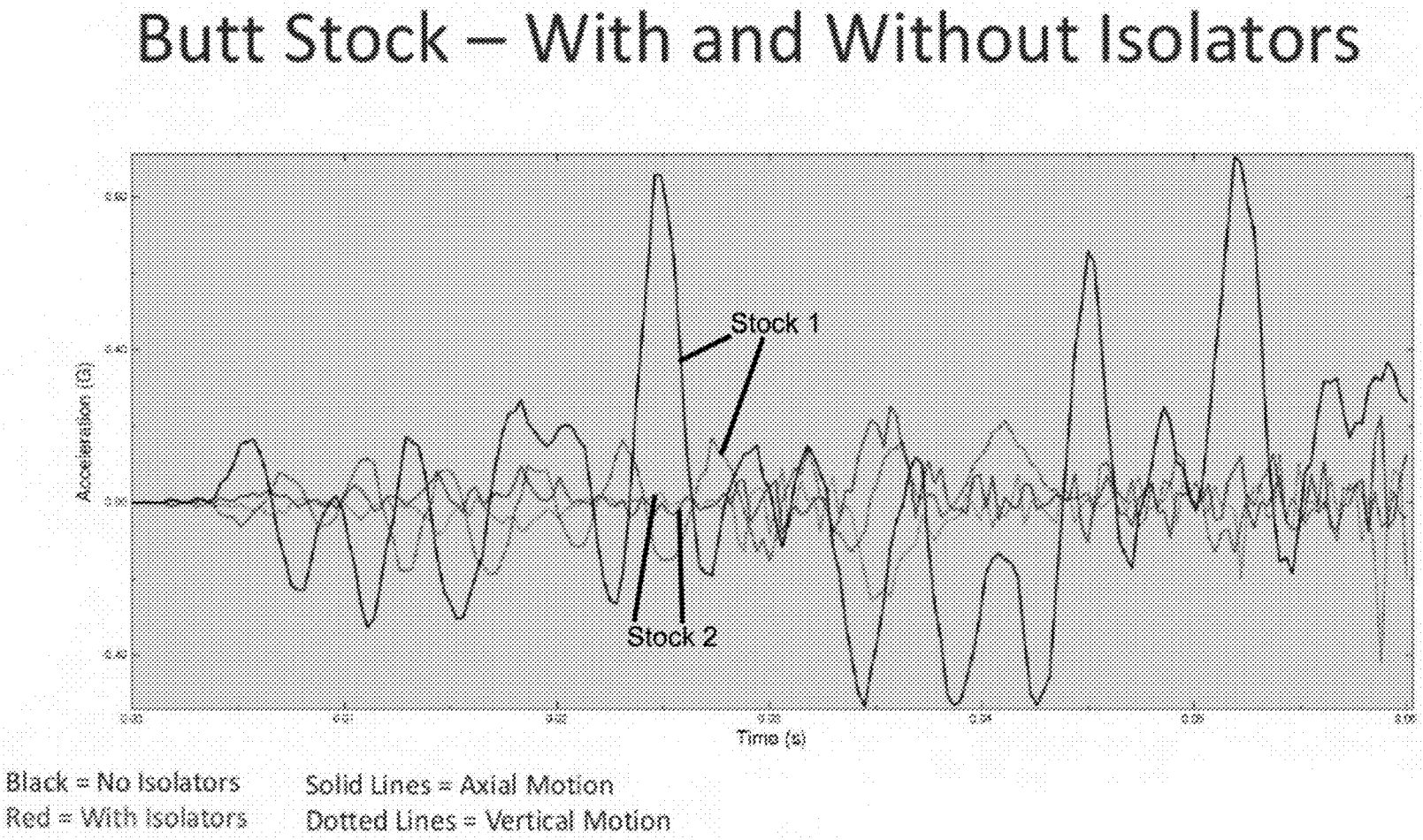
FIG. 46 is a graphical comparison of vibration felt on a butt of the crossbow stock with and without the vibration dampening system.

FIG. 46 provides a graphical representation of the vibration measured in the butt plate of Stock 1 (waves having larger magnitudes) and the vibration measured in the butt plate of Stock 2 (waves having smaller magnitudes). The vibration in the butt plate of Stock 2 was lower than the vibration in the butt plate of Stock 1. Accordingly, the vibration dampening system reduced the vibration in the butt plate of the crossbow stock by about 72%.

Figure 47:
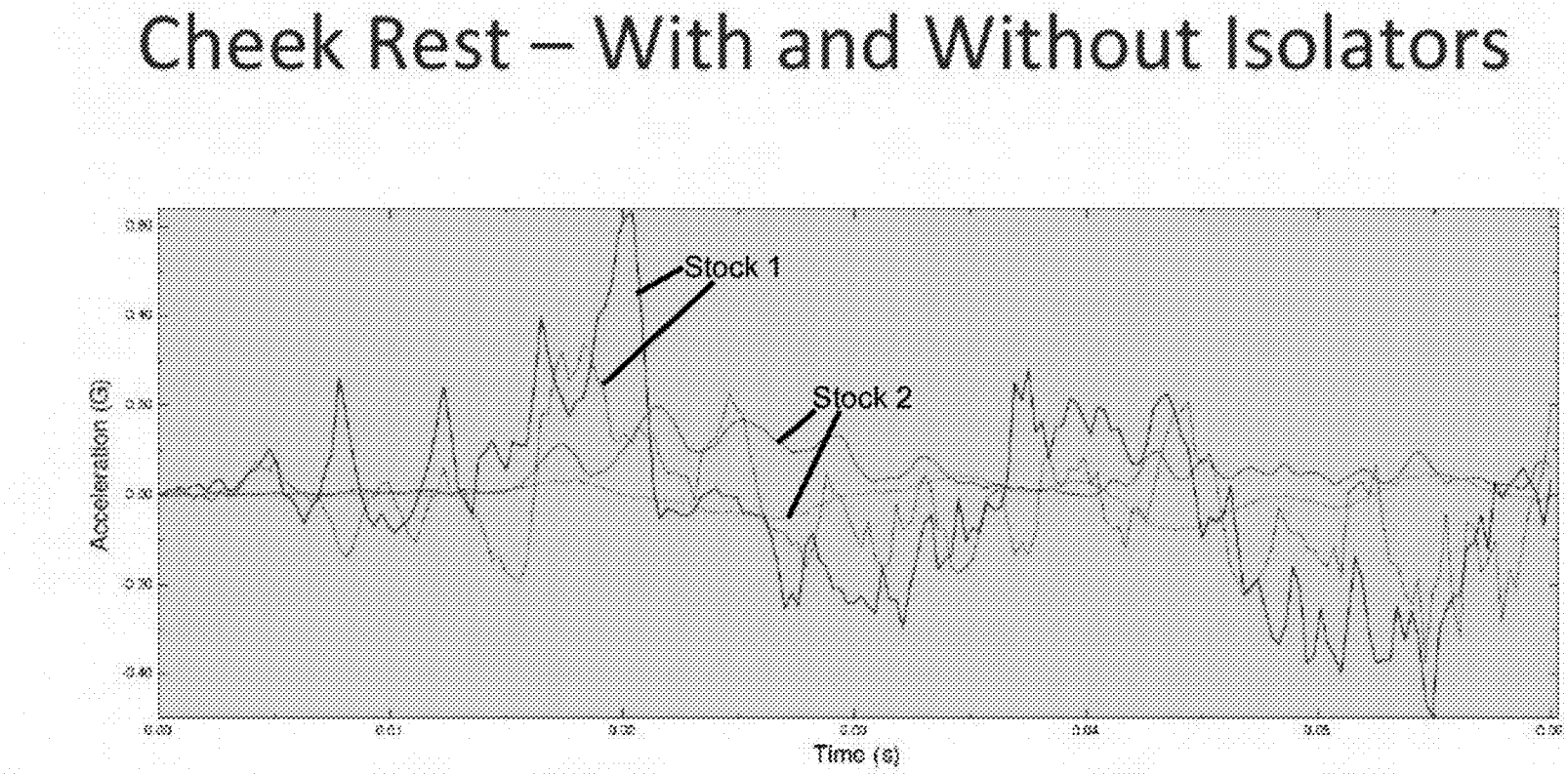
FIG. 47 is a graphical comparison of vibration felt on a cheek rest of the crossbow stock with and without the vibration dampening system.
Figure 4S:
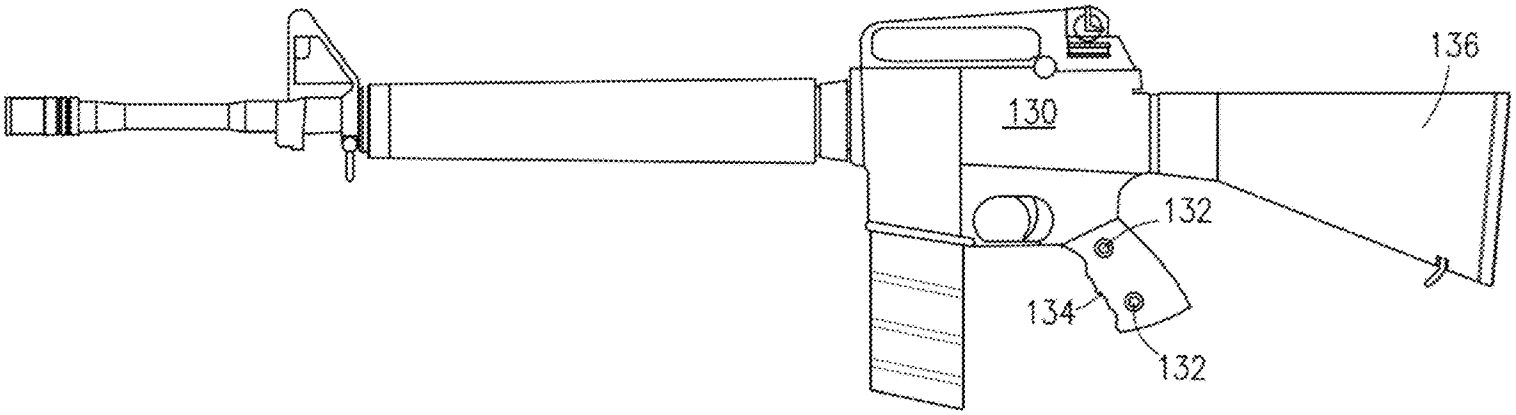

FIG. 47 provides a graphical representation of the vibration measured in the cheek rest of Stock 1 (waves having larger magnitudes) and the vibration measured in the cheek rest of Stock 2 (waves having smaller magnitudes). The vibration in the cheek rest of Stock 2 was lower than the vibration in the cheek rest of Stock 1. Accordingly, the vibration dampening system reduced the vibration in the cheek rest of the crossbow stock by about 65%.

The vibration dampening system disclosed herein may include any number of dampeners. For example, the vibration dampening system may include five central dampeners secured to body plates 30 and twenty component dampeners. In other embodiments, the vibration dampening system may include fewer central dampers and/or fewer component dampeners than the number of each described herein.

Each of the central dampening members shown in the drawings and described herein may have any shape that is configured to be secured to body plates 30. Each of the component dampening members shown in the drawings and described herein may have any shape that is configured to be secured to the corresponding component of crossbow stock 10.

Each of the central dampeners 32, 38, 40 and each of component dampeners 68, 80, 87, 98 may be formed of a polymer material, such as a thermoplastic elastomer, or rubber. Each of the dampeners may be formed of a material possessing sufficient hardness between 10° F. and 100° F., or any subrange therein (e.g., 40° F. to 70° F.), to provide the vibration reducing effect described herein.

The vibration dampening system disclosed herein may be used with or without other known dampening systems for crossbows. For example, string dampeners 120 may also be attached to forward end 22 of crossbow stock 10 as shown in FIGS. 2-6. The bow string may engage string dampeners 120 when the bow string is fired such that string dampeners 120 further reduce the vibration transmitted to a user holding crossbow stock 10. In another embodiment, other dampening systems may be incorporated into the riser that is affixed to forward end 22 of crossbow stock 10.

In one embodiment, a crossbow stock includes a separate thumb grip that is attached to a molded grip/trigger portion of the crossbow stock (with or without any vibration dampening system secured to or incorporated in the crossbow stock). The thumb grip (including thumb grip 20) may be formed of a polymer material, such as a thermoplastic elastomer.

Referring now to FIG. 48, rifle 130 may include the vibration dampening system disclosed herein. For example, dampeners 132 may be secured within pistol grip 134 of rifle 130. Dampeners 132 may be configured and secured to pistol grip 134 as described above in connection with component dampeners 68, 80, 87 or 98 or central dampeners 32, 38, or 40. When rifle 130 is fired, dampeners 132 reduce the vibration transmitted to a user's hand in contact with pistol grip 134. In one embodiment, one or more dampeners may be secured within butt portion 136 of rifle 130 to reduce the vibration transmitted to a user's shoulder in contact with butt portion 136 when rifle 130 is fired.

In the same way, the vibration dampening system may be incorporated into a pistol (e.g., by positioning one or more dampeners within a pistol grip portion of the pistol).

Figure 49:
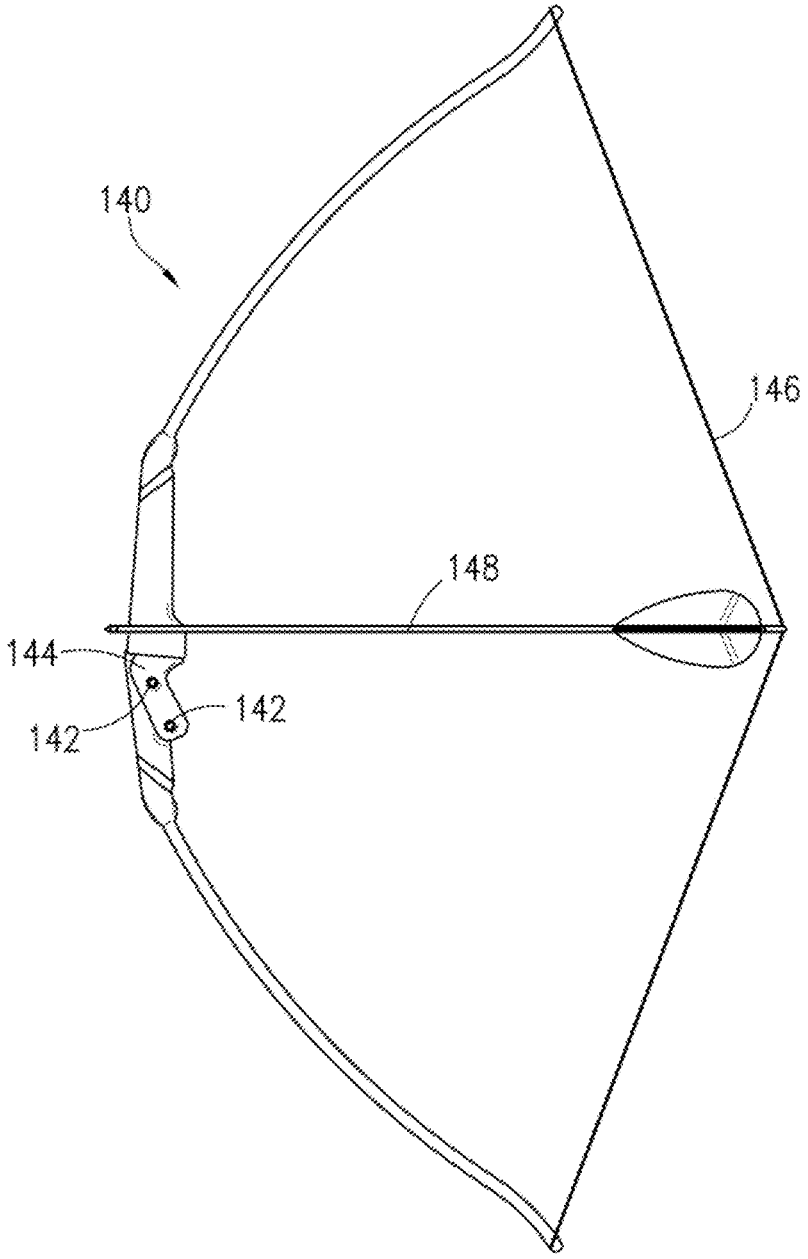
FIG. 49 is a side view of a vertical bow including a vibration dampening system.

With reference to FIG. 49, vertical bow 140 may include the vibration dampening system disclosed herein. For example, dampeners 142 may be secured within grip portion 144 of vertical bow 140. Dampeners 142 may be configured and secured to grip portion 144 as described above in connection with component dampeners 68, 80, 87, or 98 or central dampeners 32, 38, or 40. When a user releases bow string 146 of vertical bow 140 to release arrow 148, dampeners 142 reduce the vibration transmitted to a user's hand in contact with grip portion 144.

Each assembly described herein may include any combination of the described components, features, and/or functions of each of the individual assembly embodiments. Each method described herein may include any combination of the described steps in any order, including the absence of certain described steps and combinations of steps used in separate embodiments. Any range of numeric values disclosed herein shall be construed to include any subrange therein.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A crossbow stock comprising:

a forward end;

a rearward end;

one or more body plates interconnecting the forward and rearward ends;

a first central dampener operatively engaging the one or more body plates, the first central dampener reducing a vibration transmitted through the one or more body plates when a crossbow configured with the crossbow stock is fired;

wherein the one or more body plates include a foregrip section configured to accommodate a foregrip, and wherein the first central dampener operatively engages the one or more body plates at the foregrip section;

wherein the one or more body plates includes a left-side plate and a right-side plate extending longitudinally parallel to one another between the forward end and the rearward end; wherein the first central dampener is C-shaped and includes a top, a bottom, a first side, and a second side, the first and second sides interconnecting the top and bottom; and wherein the first side of the first central dampener operatively engages the left-side plate and the right side of the first central dampener operatively engages the right-side plate.

2. The crossbow stock of claim 1, wherein the first central dampener is friction fit between the left-side and right-side plates.

3. The crossbow stock of claim 1, wherein the first central dampener is composed of a thermoplastic elastomer or a rubber.

4. The crossbow stock of claim 1, wherein the one or more body plates include a crank cocking device section configured to accommodate a crank cocking device for cocking a bowstring of the crossbow into a firing position; and wherein the crossbow stock further comprises a second central dampener operatively engaging the one or more body plates at the crank cocking device section.

5. The crossbow stock of claim 4, wherein the second central dampener comprises a dampener component assembly operatively engaging the one or more body plates, the dampener component assembly including a first dampener component and a second dampener component operatively affixed to each other.

6. The crossbow stock of claim 5, wherein the first and second dampener components each includes a forward portion, a rearward portion, and a central bore extending therethrough, the forward portion having an enlarged outer diameter relative to an outer diameter of the rearward portion, the rearward portion being configured with a plurality of lobe extensions and a plurality of recessed areas, each of the recessed areas being positioned between a pair of lobe extensions.

7. The crossbow stock of claim 6, wherein each of the lobe extensions and each of the recessed areas are wedge shaped.

8. The crossbow stock of claim 6, wherein the crank cocking device section includes a first opening extending through the one or more body plates of the crossbow stock, the second central dampener assembly is operatively positioned within the first opening and configured so that the forward portion of the first dampener component faces external to a left-side of the crossbow stock, the forward portion of the second dampener component faces external to a right-side of the crossbow stock, the rearward portion of the first dampener component faces internal to the left-side of the crossbow stock, the rearward portion of the second dampener component faces internal to the right-side of the crossbow stock, and the plurality of lobe extensions of the rearward portion of the first dampener component are operatively accommodated within the plurality of recessed areas of the rearward portion of the second dampener component and the plurality of lobe extensions of the rearward portion of the second dampener component are operatively accommodated within the plurality of recessed areas of the rearward portion of the first dampener component.

9. The crossbow stock of claim 8, wherein one or more bolts are positioned within the central bores of the first and second dampener components to operatively secure the second central dampener assembly to the one or more body plates.

10. The crossbow stock of claim 9, wherein the one or more bolts comprises a first bolt and a second bolt, the first bolt being operatively positioned within the central bore of the first dampener component, the second bolt being operatively positioned with the central bore of the second dampener component, the first and second bolts each including an internal end that operatively engages one another.

11. The crossbow stock of claim 10, wherein the internal ends of the first and second bolts are threadedly engaged together.

12. The crossbow stock of claim 4, wherein the second central dampener is composed of a thermoplastic resin or a rubber.

13. The crossbow stock of claim 4, wherein the crossbow stock further comprises a third central dampener operatively engaging the one or more body plates at the crank cocking device section.

14. The crossbow stock of claim 13, wherein the third central dampener includes an elongated central portion, a first end shoulder, a first circumferential groove extending between the elongated central portion and the first end shoulder, a second end shoulder, a second circumferential groove extending between the elongated central portion and the second end shoulder, and a central bore extending through the third central dampener, the elongated central portion having an outer diameter greater than an outer diameter of the first and second end shoulders and an outer diameter of the first and second circumferential grooves, the outer diameter of the first and second circumferential grooves being less than the outer diameter of the first and second end shoulders.

15. The crossbow stock of claim 14, wherein the crack cocking device section includes a second opening extending through the one or more body plates of the crossbow stock and comprising a left-side opening in the left-side of the crossbow stock and a right-side opening in the right-side of the crossbow stock, the third central dampener assembly being operatively positioned within the second opening and configured so that the elongated central portion is operatively positioned between the left-side and the right-side of the crossbow stock, the first circumferential groove operatively engages the left-side opening with first end shoulder extending external to left-side of the crossbow stock, the second circumferential groove operatively engages the right-side opening with the second end shoulder extending external to the right-side of the crossbow stock.

16. The crossbow stock of claim 15, wherein the one or more body plates includes a left-side plate defining the left-side of the crossbow body and a right-side plate defining the right-side of the crossbow body; wherein the left-side plate and the right-side plate extend longitudinally parallel to one another between the forward end and the rearward end; and wherein the third central dampener is friction fit between the left-side and right-side plates.

17. The crossbow stock of claim 13, wherein the third central dampener is composed of a thermoplastic resin or a rubber.

18. A crossbow stock comprising:

a forward end;

a rearward end;

one or more body plates interconnecting the forward and rearward ends;

a first axis member operatively secured to the one or more body plates at the rearward end;

a first component dampener operatively secured to the first axis member, the first component dampener being configured to accommodate a butt plate of a crossbow configured with the crossbow stock, the first component dampener reducing a vibration transmitted through the one or more body plates to the butt plate when the crossbow is fired.

19. The crossbow stock of claim 18, wherein the first component dampener has a generally tubular shape with a central bore and a rear recessed portion, the rear recessed portion operatively engaging the first axis member.

20. The crossbow stock of claim 19, wherein the butt plate includes a first aperture therethrough, the first aperture being aligned with the central bore of the first component dampener, and wherein a screw is positioned within the aperture and central bore when the butt plate is operatively affixed about the rearward end of the crossbow stock.

21. The crossbow stock of claim 20, wherein the one or more body plates includes a left-side plate and a right-side plate extending longitudinally parallel to one another between the forward end and the rearward end; wherein a bolt or screw operatively secures the first axis member between the left-side and right-side plates.

22. The crossbow stock of claim 18, wherein the crossbow stock further comprises a second component dampener and a second axis member.

23. The crossbow stock of claim 18, wherein the first component dampener is composed of a thermoplastic resin or a rubber.

24. A crossbow stock comprising:

a forward end;

a rearward end;

one or more body plates interconnecting the forward and rearward ends;

at least one second component dampener operatively associated with the one or more body plates, each second component dampener having a generally tubular shape and including a central bore and at least one outer shoulder, the at least one second component dampener reducing a vibration transmitted through the one or more body plates when a crossbow configured with the crossbow stock is fired;

wherein the crossbow stock includes a second component dampener including the central bore and two outer shoulders; wherein the one or more body plates include a pistol grip section configured to accommodate a pistol grip; and wherein the second component dampener is operatively secured within a first aperture in the pistol grip section by a screw operatively positioned within the central bore of the second component dampener.

25. The crossbow stock of claim 24, wherein the crossbow stock includes a pair of second component dampeners, each second component dampener including the central bore, one outer shoulder, and a rearward end opposite the outer shoulder; wherein the one or more body plates include a pistol grip section configured to accommodate a pistol grip; wherein the pair of second component dampeners are operatively secured within a first aperture in the pistol grip section with the central bores of the pair of second component dampeners aligned and the rearward ends of the pair of second component dampeners in contact with one another; and wherein a screw is operatively positioned within the central bores of the pair of second component dampeners.

26. The crossbow stock of claim 25, further comprising a second pair of second component dampeners operatively secured within a second aperture in the pistol grip section.

27. The crossbow stock of claim 24, wherein the crossbow stock includes a second component dampener including the central bore and two outer shoulders; wherein the one or more body plates include a cheek rest section containing a base portion configured to accommodate a cheek rest; and wherein the second component dampener is operatively secured within a first aperture in the base portion of the cheek rest section by a screw operatively positioned within the central bore of the second component dampener.

28. The crossbow stock of claim 24, wherein the crossbow stock includes a pair of second component dampeners, each second component dampener including the central bore, one outer shoulder, and a rearward end opposite the outer shoulder; wherein the one or more body plates include a cheek rest section containing a base portion configured to accommodate a cheek rest; and wherein the pair of second component dampeners are operatively secured within a first aperture in the base portion of the cheek rest section with the central bores of the pair of second component dampeners aligned and the rearward ends of the pair of second component dampeners in contact with one another; and wherein a screw is operatively positioned within the central bores of the pair of second component dampeners.

29. The crossbow stock of claim 28, further comprising a second pair of second component dampeners operatively secured within a second aperture in the base portion of the cheek rest section.

30. The crossbow stock of claim 24, wherein the crossbow stock includes a second component dampener including the central bore and two outer shoulders; wherein the one or more body plates include a thumb grip section containing a recess configured to accommodate a thumb grip, the thumb grip including an outer grip surface having a generally concave shape and a central bore extending vertically through the thumb grip, the thumb grip section including an aperture aligning with the central bore of the thumb grip when the thumb grip is operatively positioned within the recess of the thumb grip section; wherein the second component dampener is operatively secured to the thumb grip section and extends within the central bore of the thumb grip; and wherein a screw is operatively positioned through the aperture in the thumb grip section and within the central bore of the second component dampener.

31. The crossbow stock of claim 24, wherein the crossbow stock includes a pair of second component dampeners, each second component dampener including the central bore, one outer shoulder, and a rearward end opposite the outer shoulder; wherein the one or more body plates include a thumb grip section containing a recess configured to accommodate a thumb grip, the thumb grip including an outer grip surface having a generally concave shape and a central bore extending vertically through the thumb grip, the thumb grip section including an aperture aligning with the central bore of the thumb grip when the thumb grip is operatively positioned within the recess of the thumb grip section; wherein the pair of second component dampeners are operatively secured to the thumb grip section and extend within the central bore of the thumb grip with the central bores of the pair of second component dampeners aligned and the rearward ends of the pair of second component dampeners in contact with one another; and wherein a screw is operatively positioned through the aperture in the thumb grip section and within the central bores of the pair of second component dampeners.

32. The crossbow stock of claim 24, wherein the pair of second component dampeners are each composed of a thermoplastic resin or a rubber.

33. A crossbow stock comprising:

a forward end;

a rearward end;

one or more body plates interconnecting the forward and rearward ends, the one or more body plates including a foregrip section configured to accommodate a foregrip of a crossbow configured with the crossbow stock; a pair of third component dampeners operatively secured between a left-side of the crossbow stock and a right-side of the crossbow stock in the foregrip section, each third component dampener having a generally tubular shape with a central bore and including an enlarged shoulder, a body portion, and a circumferential groove extending between the enlarged shoulder and the body portion, the enlarged shoulder having an outer diameter greater than an outer diameter of the body portion and an outer diameter of the circumferential groove, the outer diameter of the circumferential groove being less than the outer diameter of the body portion, the pair of third component dampeners being aligned such that an end of each of the body portions of the pair of third component dampeners are operatively positioned adjacent to one another and the central bores of the pair of third component dampeners are in communication, the pair of third component dampeners reducing a vibration transmitted through the one or more body plates to the foregrip when the crossbow is fired.

34. The crossbow stock of claim 33, wherein the pair of third component dampeners each further includes an insert molded into the body portion, the insert having a threaded bore aligned with the central bore.

35. The crossbow stock of claim 34, wherein the insert is made of a brass, a stainless steel, or a coated steel.

36. The crossbow stock of claim 34, wherein the circumferential groove of one of the third component dampeners operatively engages an aperture in the left-side of the crossbow stock and the circumferential groove of the other third component dampener operatively engages an aperture in the right-side of the crossbow stock.

37. The crossbow stock of claim 36, wherein when the foregrip is operatively positioned about the foregrip section, an aperture in a left-side section of the foregrip aligns with the aperture in the left-side of the crossbow stock, an aperture in a right-side section of the foregrip aligns with the aperture in the right-side of the crossbow stock, the apertures in the left and right side sections of the foregrip align with the central bores of the pair of third component dampeners, and wherein a front face of the shoulder of the one of the third component dampeners extends external to the left-side of the crossbow stock and contacts the left side section of the foregrip, and a front face of the shoulder of the other third component dampener extends external to the right-side of the crossbow stock and contacts the right side section of the foregrip.

38. The crossbow stock of claim 37, wherein the foregrip is operatively secured to the foregrip section by a screw extending within the apertures of the left and right side sections of the foregrip, the apertures of the left-side and right-side of the crossbow section, and the central bores of the pair of third component dampeners.

39. The crossbow stock of claim 33, further comprising a second pair of third component dampeners operatively secured between the left-side of the crossbow stock and the right-side of the crossbow stock in the foregrip section, each third component dampener of the second pair of third component dampeners having a generally tubular shape with a central bore and including an enlarged shoulder, a body portion, and a circumferential groove extending between the enlarged shoulder and the body portion, the enlarged shoulder having an outer diameter greater than an outer diameter of the body portion and an outer diameter of the circumferential groove, the outer diameter of the circumferential groove being less than the outer diameter of the body portion, the second pair of third component dampeners being aligned such that an end of each of the body portions of the second pair of third component dampeners are operatively positioned adjacent to one another and the central bores of the second pair of third component dampeners are in communication, the second pair of third component dampeners reducing a vibration transmitted through the one or more body plates to the foregrip when the crossbow is fired.

40. The crossbow stock of claim 33, wherein the pair of third component dampeners are each composed of a thermoplastic resin or a rubber.

* * * * *